US010669819B2

(12) United States Patent
Miller et al.

(10) Patent No.: US 10,669,819 B2
(45) Date of Patent: Jun. 2, 2020

(54) SUBSEA CONTROL POD DEPLOYMENT AND RETRIEVAL SYSTEMS AND METHODS

(71) Applicant: National Oilwell Varco, L.P., Houston, TX (US)

(72) Inventors: Travis James Miller, Cypress, TX (US); Richard Watson Cowan, Houston, TX (US); Alex Michael Belote, Katy, TX (US); Frank Benjamin Springett, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 65 days.

(21) Appl. No.: 15/758,287

(22) PCT Filed: Sep. 16, 2016

(86) PCT No.: PCT/US2016/052111

§ 371 (c)(1),
(2) Date: Mar. 7, 2018

(87) PCT Pub. No.: WO2017/049071

PCT Pub. Date: Mar. 23, 2017

(65) Prior Publication Data

US 2018/0258741 A1 Sep. 13, 2018

Related U.S. Application Data

(60) Provisional application No. 62/219,468, filed on Sep. 16, 2015, provisional application No. 62/237,769, filed on Oct. 6, 2015.

(51) Int. Cl.
*E21B 41/04* (2006.01)
*E21B 19/00* (2006.01)
(Continued)

(52) U.S. Cl.
CPC ..... *E21B 41/04* (2013.01); *E21B 19/002* (2013.01); *E21B 19/008* (2013.01);
(Continued)

(58) Field of Classification Search
CPC ..... E21B 41/04; E21B 19/002; E21B 19/008; E21B 33/0355; E21B 33/038; E21B 33/064; E21B 47/06; E21B 47/065
(Continued)

(56) References Cited

U.S. PATENT DOCUMENTS 6,161,618 A 12/2000 Parks et al.
6,209,565 B1 4/2001 Hughes et al.
(Continued)

FOREIGN PATENT DOCUMENTS

GB 2357537 B 11/2002
GB 2484192 A 4/2012

OTHER PUBLICATIONS

Choate, T.G.A., et al., "EDIPS ROV Control Pod Replacement Tool," Offshore Technology Conference, May 1, 1989, pp. 35-44 (10 p.).

(Continued)

*Primary Examiner* — Anna M Momper
*Assistant Examiner* — Patrick F Lambe
(74) *Attorney, Agent, or Firm* — Conley Rose, P.C.

(57) ABSTRACT

A device for retrieving a control pod from a subsea BOP stack or deploying a control pod to a subsea BOP stack includes a base having a longitudinal axis, a first end, and a second end axially opposite the first end. The base includes a plurality of axially adjacent bays positioned side-by-side between the first end and the second end. Each bay is sized to hold one control pod. In addition, the device includes a trolley moveably coupled to the base. The trolley includes a first stall and a second stall axially adjacent the first stall.
(Continued)

Each stall is configured to hold one control pod. Further, the device includes a housing fixably coupled to the base. Still further, the device includes a control pod actuation assembly coupled to the housing. The control pod actuation assembly is configured to move the trolley axially relative to the base and the housing to align each stall of the trolley with at least one bay of the base. The control pod actuation assembly includes a linear actuator configured to extend and retract through one bay of the base.

17 Claims, 37 Drawing Sheets

(51) Int. Cl.

| | |
|---|---|
| ***E21B 33/035*** | (2006.01) |
| ***E21B 33/038*** | (2006.01) |
| *E21B 33/064* | (2006.01) |
| *E21B 47/06* | (2012.01) |

(52) U.S. Cl.
CPC ..... *E21B 33/038* (2013.01); *E21B 33/0355* (2013.01); *E21B 33/064* (2013.01); *E21B 47/06* (2013.01); *E21B 47/065* (2013.01)

(58) Field of Classification Search
USPC ..... 166/339
See application file for complete search history.

(56) References Cited

U.S. PATENT DOCUMENTS

| | | | | |
|---|---|---|---|---|
| 6,422,315 | B1 * | 7/2002 | Dean | E21B 33/0355 166/339 |
| 6,860,525 | B2 | 3/2005 | Parks | |
| 8,020,623 | B2 | 9/2011 | Parks et al. | |
| 8,727,013 | B2 | 5/2014 | Buckley et al. | |
| 8,820,410 | B2 | 9/2014 | Parks et al. | |
| 2004/0154804 | A1 | 8/2004 | Williams | |
| 2010/0155073 | A1 | 6/2010 | Blank et al. | |

OTHER PUBLICATIONS

PCT/US2016/052103 International Search Report and Written Opinion dated Jan. 24, 2017 (15 p.).

* cited by examiner

SUBSEA CONTROL POD DEPLOYMENT AND RETRIEVAL SYSTEMS AND METHODS

CROSS-REFERENCE TO RELATED APPLICATIONS

This application is a 35 U.S.C. § 371 national stage application of PCT/US2016/052111 filed Sep. 16, 2016, and entitled "Subsea Control Pod Deployment and Retrieval Systems and Methods," which claims benefit of U.S. provisional patent application Ser. No. 62/237,769 filed Oct. 6, 2015, and entitled "Subsea Control Pod Deployment and Retrieval Systems and Methods," and also claims the benefit of U.S. provisional patent application Ser. No. 62/219,468 filed Sep. 16, 2015, and entitled "Subsea Control Pod Deployment and Retrieval Systems and Methods," each of which is hereby incorporated herein by reference in its entirety for all purposes.

STATEMENT REGARDING FEDERALLY SPONSORED RESEARCH OR DEVELOPMENT

Not applicable.

BACKGROUND

Embodiments described herein relate generally to systems and methods for deploying and retrieving subsea control pods. More particularly, embodiments described herein relate generally to systems and methods for deploying and retrieving subsea blowout preventer (BOP) and lower marine riser package (LMRP) control pods in deepwater environments exceeding 5,000 feet and generally independent of subsea remotely operated vehicles (ROVs).

Subsea wells are typically made up by installing a primary conductor into the seabed and securing a wellhead secured to the upper end of the primary conductor at the sea floor. In addition, a subsea stack, also referred to as a blowout preventer (BOP) stack, is installed on the wellhead. The stack usually includes a blowout preventer mounted to the upper end of the wellhead and a lower marine riser package (LMRP) mounted to the upper end of the BOP. The primary conductor, wellhead, BOP, and LMRP are typically installed in a vertical arrangement one-above-the-other. The lower end of a riser extending subsea from a surface vessel or rig is coupled to a flex joint at the top of the LMRP. For drilling operations, a drill string is suspended from the surface vessel or rig through the riser, LMRP, BOP, wellhead, and primary conductor to drill a borehole. During drilling, casing strings that line the borehole are successively installed and cemented in place to ensure borehole integrity.

A subsea control system is used to operate and monitor the BOP stack as well as monitor wellbore conditions. For example, the control system can actuate valves (e.g., safety valves, flow control choke valves, shut-off valves, diverter valves, etc.), actuate chemical injection systems, monitor operation of the BOP and LMRP, monitor downhole pressure, temperature and flow rates, etc. The subsea control system typically comprises control modules or pods removably mounted to the BOP and LMRP. Redundant control pods are typically provided on each BOP and LMRP to enable operation and monitoring functions in the event one of the redundant control pods fails. Control pods mounted to the LMRP are often referred to as "primary" pods, whereas control pods mounted to the BOP are often referred to as "secondary" or "backup" pods. Electrical power, hydraulic power, and command signals are provided to the control pods from the surface vessel or rig. The control pods utilize the electrical and hydraulic power to operate and monitor the BOP stack as well as monitor the wellbore conditions in accordance with the command signals.

In the event of a control pod component failure, it may be desirable to retrieve the control pod to the surface to be repaired or replaced, and then deploy the repaired control pod or a replacement control pod subsea to effectively replace the faulty control pod. Traditionally, there are limited options for doing so, and further, some of the options are only applicable in shallow water environments or require the retrieval of the entire LMRP.

BRIEF SUMMARY OF THE DISCLOSURE

Embodiments of devices for retrieving control pods from a subsea BOP stack and/or deploying control pods to a subsea BOP stack are disclosed herein. In one embodiment, the device comprises a base having a longitudinal axis, a first end, and a second end axially opposite the first end. The base includes a plurality of axially adjacent bays positioned side-by-side between the first end and the second end. Each bay is sized to hold one control pod. In addition, the device comprises a trolley moveably coupled to the base. The trolley includes a first stall and a second stall axially adjacent the first stall. Each stall is configured to hold one control pod. Further, the device comprises a housing fixably coupled to the base. Still further, the device comprises a control pod actuation assembly coupled to the housing. The control pod actuation assembly is configured to move the trolley axially relative to the base and the housing to align each stall of the trolley with at least one bay of the base. The control pod actuation assembly includes a linear actuator configured to extend and retract through one bay of the base.

Embodiments of methods for replacing a first control pod of a BOP stack are disclosed herein. In one embodiment, the method comprises (a) loading a second control pod onto a base of a control pod exchange device. The control pod exchange device includes the base, a housing fixably coupled to the base, and a connector assembly releasably coupled to the housing. In addition, the method comprises (b) lowering the control pod exchange device subsea after (a). Further, the method comprises (c) coupling a BOP stack interface member to the BOP stack after (b). A flexible cable has a first end coupled to the housing and a second end coupled to the BOP stack interface member. Still further, the method comprises (d) decoupling the connector assembly from the housing after (c). The method also comprises (e) lowering the base and the housing relative to the connector assembly after (d).

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
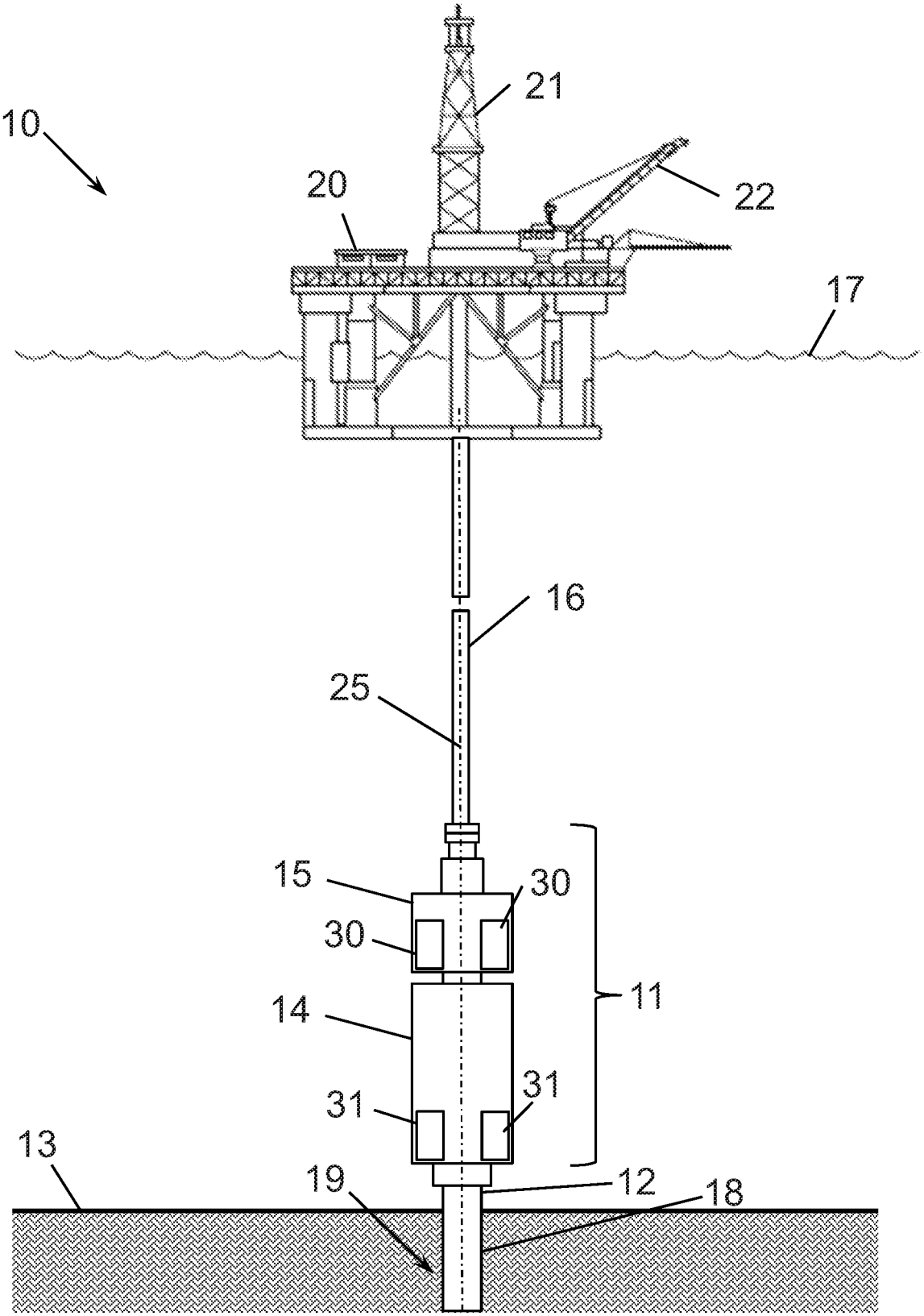
FIG. 1 is a schematic view of an embodiment of an offshore system for drilling and/or production.
Figure 2:
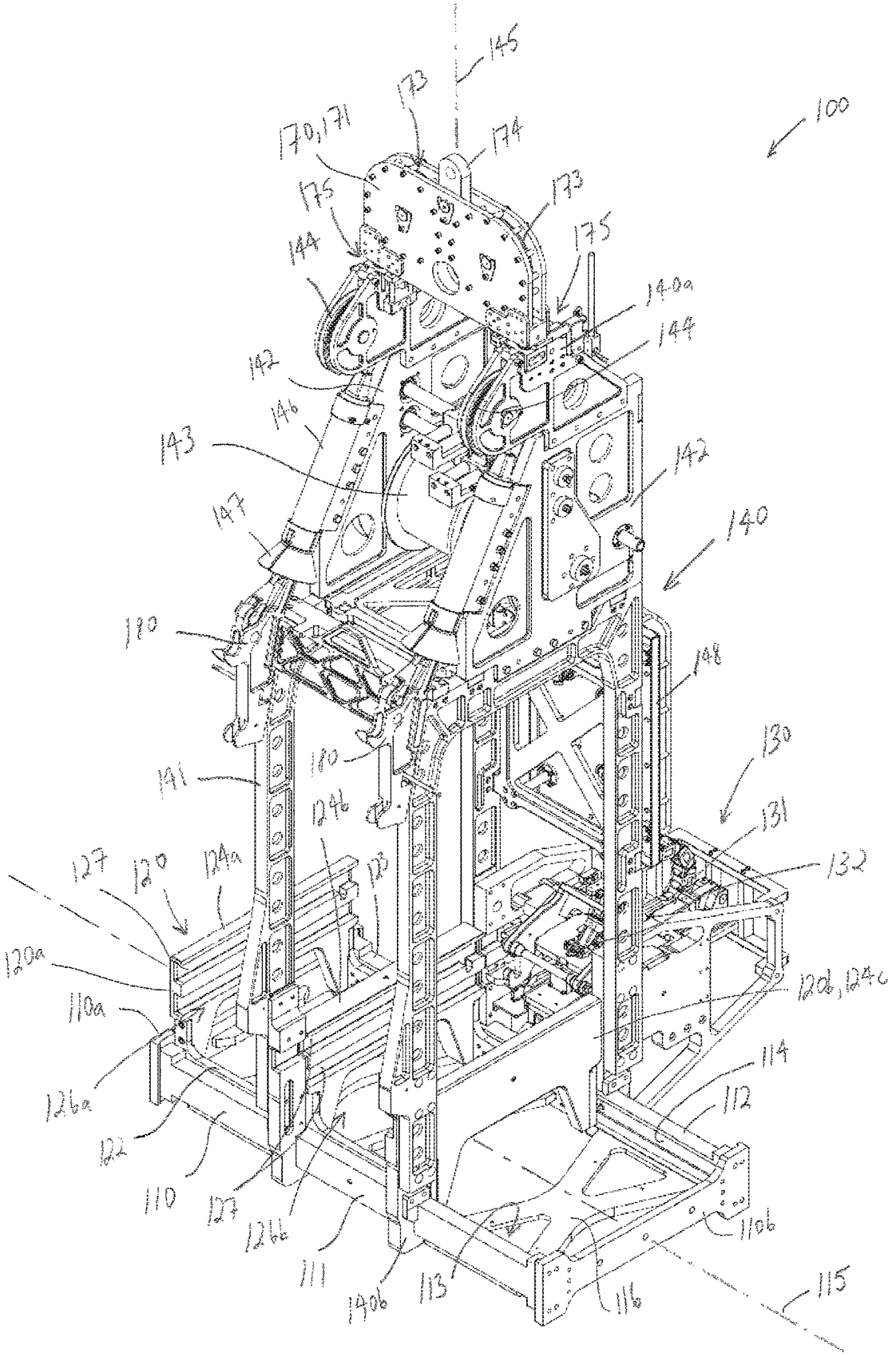
FIG. 2 is a perspective front view of an embodiment of a control pod exchange device for deploying a control pod to and/or retrieving a control pod from the offshore system of FIG. 1.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As previously described, a failing subsea control pod can be retrieved to the surface and replaced with a properly functioning control pod. In shallow water offshore operations (i.e., at water depths up to about 6,000 ft.), guidelines or wires extending vertically from the surface vessel or rig to the subsea template or wellhead are used to guide and land the BOP and LMRP onto the wellhead for the initial assembly of the BOP stack. The guidelines generally remain in place after building up the BOP stack, and thus, are generally considered to be permanently installed. Such guidelines can be used to guide and run control pods to and from the BOP stack. However, this technique is typically limited to shallow water operations (guidelines are usually only installed and available for use in shallow water operations), and further, this technique usually cannot be used to retrieve and deploy control pods mounted to the lower portion of the BOP stack (e.g., control pods mounted to the BOP) because LMRP at the upper end of the BOP stack does not provide sufficient clearance around the guidewires to enable the direct vertical movement of control pods along the guidelines to and from the portions of the BOP stack below the LMRP. Thus, control pods mounted to the lower portion of the BOP stack usually cannot utilize guidelines for retrieval and deployment because the guidelines extend vertically, whereas the control pods must be moved laterally away from the BOP stack before being moved vertically upward to the surface. In deep water offshore operations (i.e., at water depths greater than 6,000 ft.), guidelines are typically not available. In some cases, subsea remotely operated vehicles (ROVs) may be used to facilitate the retrieval, deployment, and installation of subsea control pods. However, operation of subsea ROVs can be negatively impacted by a variety of factors including, without limitation, subsea currents, limitations on visibility, payload limits, thrust capacity and accuracy, and ROV pilot skill and experience. For example, modern control pods are often substantially heavier than shallow water guideline retrievable control pods (e.g., 40,000 lbs. versus 2,000 lbs). Consequently, retrieving, deploying, and installing control pods via subsea ROVs may not be desirable or a viable option. Thus, embodiments of systems and devices described herein enable the retrieval, deployment, and installation of subsea control pods on any part of the BOP stack (e.g., the BOP, LMRP, upper part of the BOP stack, lower part of the BOP stack, etc.) without the use of conventional guidelines and with limited or no reliance on subsea ROVs. Although embodiments described herein reduce and/or eliminate reliance on subsea ROVs to physically manipulate and move the control pods, it should be appreciated that one or more subsea ROVs can be used to visually monitor and verify the subsea retrieval, deployment, and installation of the control pods. Moreover, although this disclosure generally describes the retrieval and replacement of faulty subsea control pods (i.e., with a different control pod), it should be appreciated embodiments described herein can also be used to retrieve a faulty control pod to the surface, rapidly repair of the faulty control pod at the surface, and then deploy the repaired control pod subsea for subsequent installation on the BOP stack.

Referring now to FIG. 1, an embodiment of an offshore system 10 for drilling and/or producing a subsea well is shown. In this embodiment, system 10 includes a subsea blowout preventer (BOP) stack 11 mounted to a wellhead 12 at the sea floor 13. Stack 11 includes a blowout preventer (BOP) 14 attached to the upper end of wellhead 12 and a lower marine riser package (LMRP) 15 connected to the upper end of BOP 14. A marine riser 16 extends from a surface vessel 20 at the sea surface 17 to LMRP 15. In this embodiment, vessel 20 is a floating platform, and thus, may also be referred to as platform 20. In other embodiments, the vessel (e.g., vessel 20) can be a drill ship or any other vessel disposed at the sea surface for conducting offshore drilling and/or production operations. Platform 20 includes a drilling derrick 21 and a lifting device 22, which in this embodiment is a full depth crane.

Riser 16 is a large-diameter pipe that connects LMRP 15 to floating platform 20. During drilling operations, riser 16 takes mud returns to platform 20. A primary conductor 18 extends from wellhead 12 into the subterranean wellbore 19.

BOP 14, LMRP 15, wellhead 12, and conductor 18 are arranged such that each shares a common central axis 25. In other words, BOP 14, LMRP 15, wellhead 12, and conductor 18 are coaxially aligned. In addition, BOP 14, LMRP 15, wellhead 12, and conductor 18 are vertically stacked one-above-the-other, and the position of platform 20 is controlled such that axis 25 is vertically or substantially vertically oriented. In general, platform 20 can be maintained in position over stack 11 with mooring lines and/or a dynamic positioning (DP) system. However, it should be appreciated that platform 20 moves to a limited degree during normal drilling and/or production operations in response to external loads such as wind, waves, currents, etc. Such movements of platform 20 result in the upper end of riser 16, which is secured to platform 20, moving relative to the lower end of riser 16, which is secured to LMRP 15. Wellhead 12, BOP 14 and LMRP 15 are generally fixed in position at the sea floor 13, and thus, riser 16 may flex and pivot about its lower and upper ends as platform 20 moves at the surface 17. Consequently, although riser 16 is shown as extending vertically from platform 20 to LMRP 15 in FIG. 1, riser 16 may deviate somewhat from vertical as platform 20 moves at the surface 17.

Referring still to FIG. 1, a pair of control pods 30 are releasably coupled to LMRP 15 and a pair of control pods 31 are releasably coupled to BOP 14. Pods 30 are positioned above pods 31 (pods 30 are not necessarily directly over pods 31), and pods 30 are coupled to LMRP 15, whereas pods 31 are coupled to BOP 14. It should be appreciated that pods 30 and pods 31 can control functions in the LMRP 15 and/or BOP 14. For purposes of clarity and further explanation, pods 30 may also be referred to as "primary" pods 30, and pods 31 may also be referred to as "secondary" pods 31. In this embodiment, primary pods 30 are redundant meaning each primary pod 30 can perform all of the functions as the other primary pod 30, and secondary pods 31 are backups to the primary pods 30, each pod 30, 31 being able to control select functions in LMRP 15 and BOP 14. In general, control pods 30, 31 can perform any of the functions performed by subsea control pods known in the art. For example, each primary control pod 30 can operate and monitor LMRP 15 and BOP 14, and monitor conditions within LMRP 15 and BOP 14 (e.g., temperature, pressure, flow rates, etc.), and each secondary control pod 31 can operate and monitor LMRP 15 and BOP 14, and monitor conditions within LMRP 15 and BOP 14 (e.g., temperature, pressure, flow rates, etc.). Electrical power, hydraulic power, and command signals are provided to primary control pods 30 from platform 20. Secondary control pods 31 are provided power BOP stack 11 (e.g., stored power). In addition, the interface between each control pod 30, 31 BOP stack 11 includes hydraulic and/or electrical couplings that enable pods 30, 31 to control hydraulic and/or electrical functions of LMRP 15 and BOP 14.

As will be described in more detail below, embodiments described and illustrated herein are directed to systems and methods for retrieving a failed or faulty control pod (e.g., control pod 30 or control pod 31), and replacing it with a replacement control pod (e.g., control pod 30 or control pod 31). Although embodiments described herein specifically show and described replacing a control pod 30 mounted to LMRP 15, it is to be understood that embodiments described herein can also be used in the manners described to replace a control pod 31 mounted to BOP 14. For purposes of clarity and further explanation (e.g., to aid in distinguishing failed or faulty pod 30 from replacement pod 30), in embodiments described herein, the failed or faulty pod 30 is labeled with reference numeral 30' and the replacement pod 30 is labeled with reference numeral 30". In general, the replacement pod 30" can be a new pod 30 or a repaired pod 30.

Referring now to FIGS. 2-5, 7, and 8, an embodiment of a control pod exchange device 100 for delivering a replacement control pod 30" to subsea BOP stack 11, automating the exchange of pods 30',30" (i.e., removes pod 30' from stack 11 and installs pod 30" in stack 11), and retrieving the failed or faulty control pod 30' to the surface is shown. In this embodiment, device 100 includes a base 110, a pod support tray or trolley 120 moveably coupled to base 110, an actuation assembly 130 coupled to base 110, a central housing 140 fixably attached to base 110, and a connector assembly 170 releasably coupled to housing 140.

In this embodiment, base 110 is a rectangular frame having a central or longitudinal axis 115, a first end 110*a*, a second end 110*b* axially opposite end 110*a*, a front rail 111 extending axially between ends 110*a*, 110*b*, and a rear rail 112 extending axially between ends 110*a*, 110*b*. Rails 111, 112 are parallel, each being generally horizontally oriented. The inner surface of each rail 111, 112 (i.e., the opposed faces of rails 111, 112) includes an elongate guide slot or recess 113, 114, respectively, that extends axially between ends 110*a*, 110*b*. A plurality of cross-members 116 are disposed along the bottom of base 110 and extend between rails 111, 112. Cross-members 116 provide structural integrity to base 110.

Figure 4:
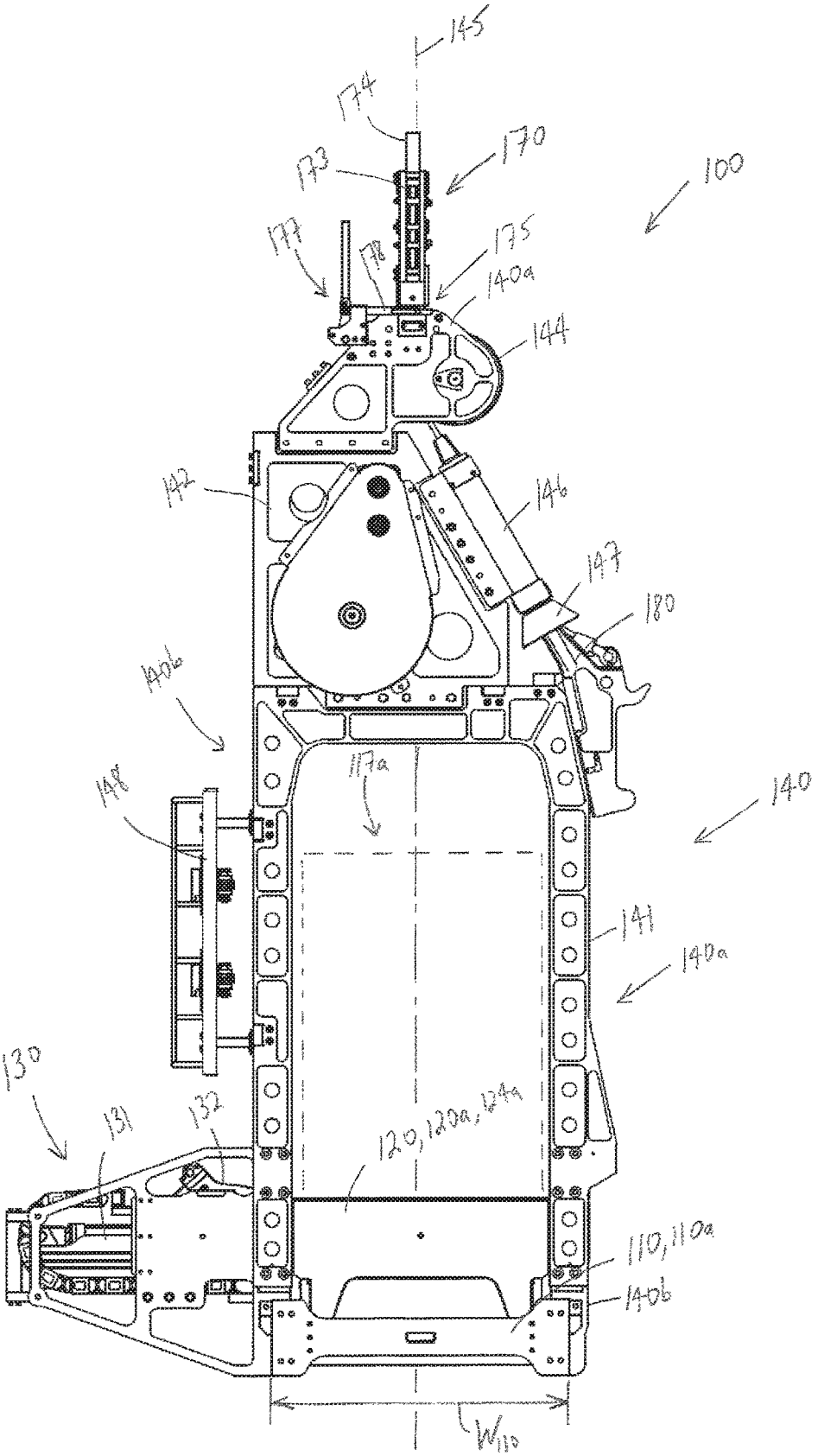
FIG. 4 is a side view of the of the control pod exchange device of FIG. 2.
Figure 5:
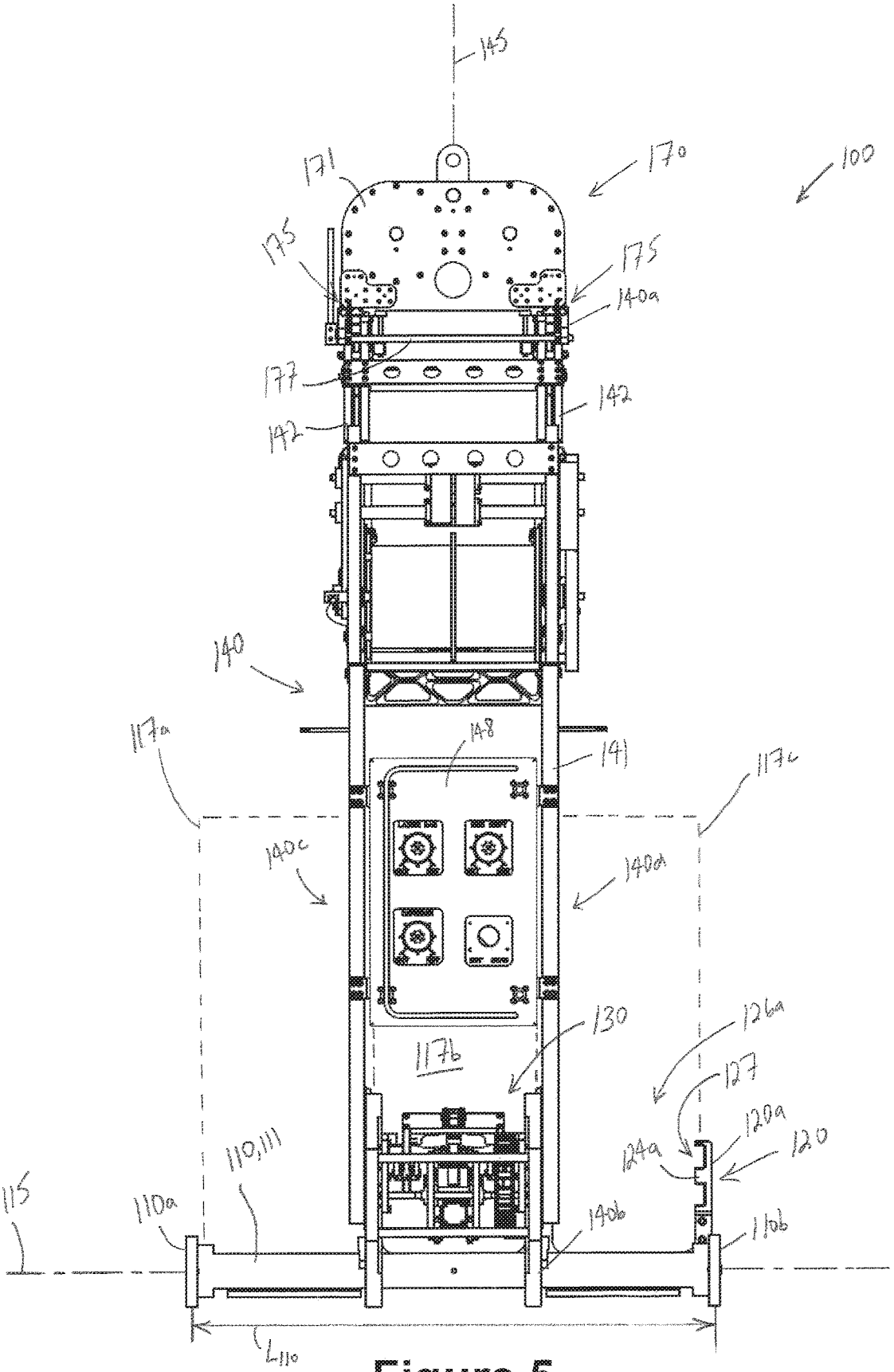
FIG. 5 is a rear view of the control pod exchange device of FIG. 2.
Figure 6:
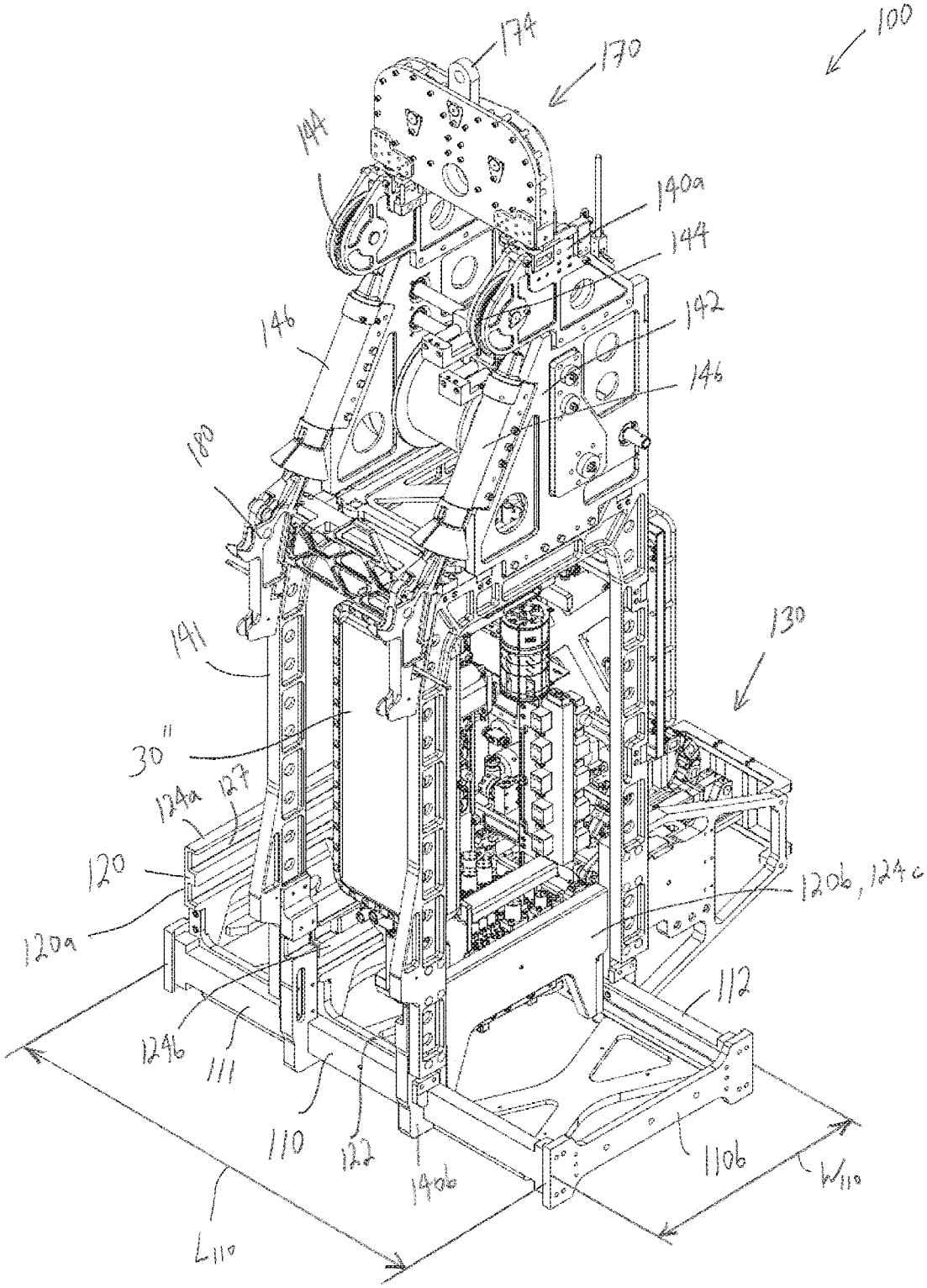
FIG. 6 is a perspective front view of the control pod exchange device of FIG. 2 carrying a control pod.

As best shown in FIGS. 4-6, base 110 has a length $L_{110}$ measured axially between ends 110*a*, 110*b* and a width $W_{110}$ measured between rails 111, 112 perpendicular to axis 115 in top view. In this embodiment, as best shown in FIG. 6, the length $L_{110}$ is about equal to or slightly greater than the total width of three control pods 30',30" positioned side-by-side, and width $W_{110}$ is about equal or slightly greater than the depth of one pod 30',30". Consequently, as shown in dashed lines in FIGS. 4 and 5, base 110 may be described as defining three bays 117*a*, 117*b*, 117*c* positioned axially side-by-side between ends 110*a*, 110*b*, each bay 117*a*, 117*b*, 117*c* being sized to hold or accommodate one control pod 30',30". Bay 117*b* is positioned between bays 117*a*, 117*c*, and thus, bay 117*b* may also be referred to herein as middle bay 117*b*, and bays 117*a*, 117*c* may also be referred to herein as side bays 117*a*, 117*c*, respectively. It should also be appreciated that middle bay 117*b* is positioned within housing 140, whereas side bays 117*a*, 117*c* are disposed outside on either lateral side of housing 140. As will be described in more detail below, during the exchange of pods 30',30" between device 100 and BOP stack 11 (i.e., transfer of pod 30" from BOP stack 11 to device 100 followed by the transfer of pod 30' from device 100 to BOP stack 11), pods 30',30" move between middle bay 117*b* and BOP stack 11.

Referring again to FIGS. 2-5, 7, and 8, pod support tray or trolley 120 is moveably coupled to base 110 and actuation assembly 130 coupled to housing 140. Trolley 120 holds and supports pods 30',30" deployed, retrieved, and carried by device 100. Actuation assembly 130 controllably moves trolley 120, and hence any pods 30',30" held by trolley 120, axially relative to base 110 and housing 140 between ends 110*a*, 110*b*. In addition, actuation assembly 130 controllably moves and transfers pod 30" from BOP stack 11 to trolley 120 and middle bay 117*b*, and controllably moves and transfers pod 30' from trolley 120 and middle bay 117*b* to BOP stack 11.

As described above, trolley 120 is positioned within base 110 and can move axially relative to base 110 and housing 140. Trolley 120 has a central axis oriented parallel to axis 115 in top view and ends 120*a*, 120*b*. In addition, trolley 120 includes a pair of elongate, parallel side rails 122, 123 extending axially between ends 120*a*, 120*b* and a plurality of axially-spaced vertical walls or dividers 124*a*, 124*b*, 124*c* extending between rails 122, 123. Dividers 124*a*, 124*b*, 124*c* are oriented perpendicular to rails 122, 123, and extend vertically upward from rails 122, 123. In addition, dividers 124 are fixably attached to rails 122, 123 such that dividers 124 move with rails 122, 124. In this embodiment, dividers 124*a*, 124*b*, 124*c* are uniformly axially-spaced with divider 124*a* disposed at end 120*a*, divider 124*c* disposed at end 120*b*, and divider 124*b* disposed in the middle of trolley 120 equidistant from ends 120*a*, 120*b*. The axial distance measured between each pair of axially adjacent dividers 124*a*, 124*b*, 124*c* (i.e., the axial distance between dividers 124*a*, 124*b* and the axial distance between dividers 124*b*, 124*c*) is about equal to or slightly greater than the width of one pod 30',30". Consequently, trolley 120 may be described as defining two receptacles or stalls 126*a*, 126*b* within trolley 120 that are positioned axially side-by-side between ends 120*a*, 120*b* for holding or accommodating one control pod 30',30"—stall 126*a* is positioned between dividers 124*a*, 124*b* and stall 126*b* is positioned between dividers 124*b*, 124*c*. The opposed vertical faces or surfaces of dividers 124*a*, 124*b*, 124*c* include elongate slots or recesses 127 disposed above base 110. Recesses 127 are sized and positioned to receive mating profiles on the outer lateral sides of pods 30',30", thereby allowing pods 30',30" to slide into and out of each stall 126*a*, 126*b*.

Rails 122, 123 slidingly engages rails 111, 112, respectively, thereby allowing trolley 120 to move axially within base 110 between ends 110*a*, 110*b*. In this embodiment, each rail 122, 123 includes extension(s) or wheel(s) that are seated in guide slots 113, 114, respectively, of the corresponding rail 111, 112, thereby allowing trolley 120 to slide axially back and forth between ends 110*a*, 110*b* of base 110.

Referring still to FIGS. 2-5, 7, and 8, actuation assembly 130 is generally disposed at the rear of device 100 and is mounted to housing 140 and rear rail 113. In addition, actuation assembly 130 is aligned with middle bay 117*b*. As previously described, actuation assembly 130 controllably moves trolley 120 back and forth between ends 110*a*, 110*b* of base 110 and controllably moves pods 30',30" between BOP stack 11 and trolley 120. In this embodiment, actuation assembly 130 includes a motor (not visible) for moving trolley 120 axially between ends 110*a*, 110*b*, and a double acting linear actuator 131 for transferring pods 30',30" to and from trolley 120 and bay 117*b*. In general, the motor can be any suitable motor known in the art including, without limitation, a hydraulic or electric motor, and the actuator 131 can be any suitable actuator known in the art including, without limitation, a hydraulic cylinder or an electric actuator.

In this embodiment, the motor of actuation assembly 130 includes an output gear that engages a mating toothed rack provided on rail 113, and thus, by rotating the gear in a first direction, the motor moves trolley 120 away from end 110*a* and toward end 110*b*, and by rotating the gear in a second direction opposite the first direction, the motor moves trolley 120 away from end 110*b* and toward end 110*a*. Thus, actuation assembly 130 can controllably move trolley 120 relative to base 110 to align stall 126*a* or stall 126*b* with middle bay 117*b*. As shown in FIGS. 2-5, when stall 126*a* of trolley 120 is aligned with middle bay 117*b*, stall 126*b* is aligned with side bay 117*c*, and when stall 126*b* of trolley 120 is aligned with middle bay 117*b*, stall 126*a* is aligned with side bay 117*a*.

In this embodiment, actuator 131 can extend and retract in a direction perpendicular to axis 115 in top view. Since actuation assembly 130 is aligned with middle bay 117*b*, actuator 131 extends into and retracts out of middle bay 117*b*. Accordingly, actuator 131 may be described as having an extended position and a retracted position—in the extended position, actuator 131 extends into and through middle bay 117*b*; and in the retracted position, actuator 131 is withdrawn from middle bay 117*b*. A pod interface assembly 132 is coupled to the free end of actuator 131 that extends through middle bay 117*b*. Interface assembly 132 releasably engages and grips pods 30',30" during installation into and retrieval from BOP stack 11. More specifically, to remove pod 30" from BOP stack 11, device 100 is properly aligned with BOP stack 11 and one empty stall 126*a*, 126*b* (i.e., a stall 126*a*, 126*b* with no pod 30 disposed therein) is aligned with middle bay 117*b*, actuator 131 is extended through middle bay 117*b* to pod 30", interface assembly 132 positively engages pod 30", and then actuator 131 retracts to pull pod 30" from BOP stack 11 into middle bay 117*b* and stall 126*a*, 126*b* aligned therewith; and to install pod 30' in BOP stack 11 following the removal of pod 30", device 100 is properly aligned with BOP stack 11 and the stall 126*a*, 126*b* carrying pod 30' is aligned with middle bay 117*b*, interface assembly 132 positively engages pod 30' and actuator 131 is extended through middle bay 117*b* to push pod 30' into BOP stack 11.

Referring still to FIGS. 2-5, 7, and 8, housing 140 has a vertically oriented central or longitudinal axis 145, an upper end 140*a* distal base 110, and a lower end 140*b* fixably attached to base 110. In this embodiment, housing 140 includes rectangular frame 141 and a pair of lateral sidewalls 142 extending from frame 141. More specifically, frame 141 extends from lower end 140*b* to sidewalls 142, and sidewalls 142 extend from frame 141 to upper end 110*a*. As best shown in FIGS. 4 and 5, frame 140 has a front side 140*a*, a back side 140*b*, and lateral sides 140*c*, 140*d*. Sidewalls 142 are aligned with and extend upward from lateral sides 140*c*, 140*d*. Front side 140*a* and lateral sides 140*c*, 140*d* are generally open, thereby allowing pods 30',30" to pass through sides 140*a*, 140*b*, 140*c* and allowing trolley 120 to pass through sides 140*c*, 140*d*. In this embodiment, a control panel 148 and actuation assembly 130 are mounted to back side 140*b*. Although device 100 can be operated from the surface, control panel 141 allows a subsea ROV to operate device 100 as desired (e.g., operate actuation assembly 130).

Housing 140 also includes a winch 143 rotatably disposed between sidewalls 142, a pair of laterally spaced sheaves 144 rotatably coupled to sidewalls 142, and a pair of tubular guides 146 fixably attached to sidewalls 142. Winch 143 is rotatably coupled to sidewalls between frame 141 and upper end 140*a*. One sheave 144 is coupled to each sidewall 142 at upper end 140*a*. In particular, each sheave 144 is positioned along the front edge of each sidewall 142. Sheaves 144 rotate about a common horizontal axis oriented parallel to axis 115, and winch 143 rotates about a horizontal axis oriented parallel to axis 115.

One tubular guide 146 is coupled to the front edge of each sidewall 142 just below a corresponding sheave 144. Each tubular guide 146 is oriented at an acute angle measured upward from central axis 145 in side view and includes a funnel 147 at its lower end. As will be described in more detail below, funnels 147 slidingly receive BOP stack interface members 180 releasably coupled to BOP stack 11 to align device 100 with BOP stack 11 such that middle bay 117*b* is aligned with and opposed pod 30'. In this embodiment, each interface member 180 is a spear, and thus, each may also be referred to herein as a spear 180.

Referring still to FIGS. 2-5, 7, and 8, connector assembly 170 is releasably attached to upper end 140*a* of housing 140 and includes a body 171, a pair of laterally spaced sheaves 173 rotatably coupled to body 171, and a connector 174. In this embodiment, body 171 includes a pair of parallel spaced plates that are fixably attached. Sheaves 173 are positioned between the plates, and connector 174 is fixably attached to the plates at the top of body 171. Sheaves 173 rotate about laterally spaced parallel horizontal axes oriented perpendicular to axis 115 in top view.

Figure 7:
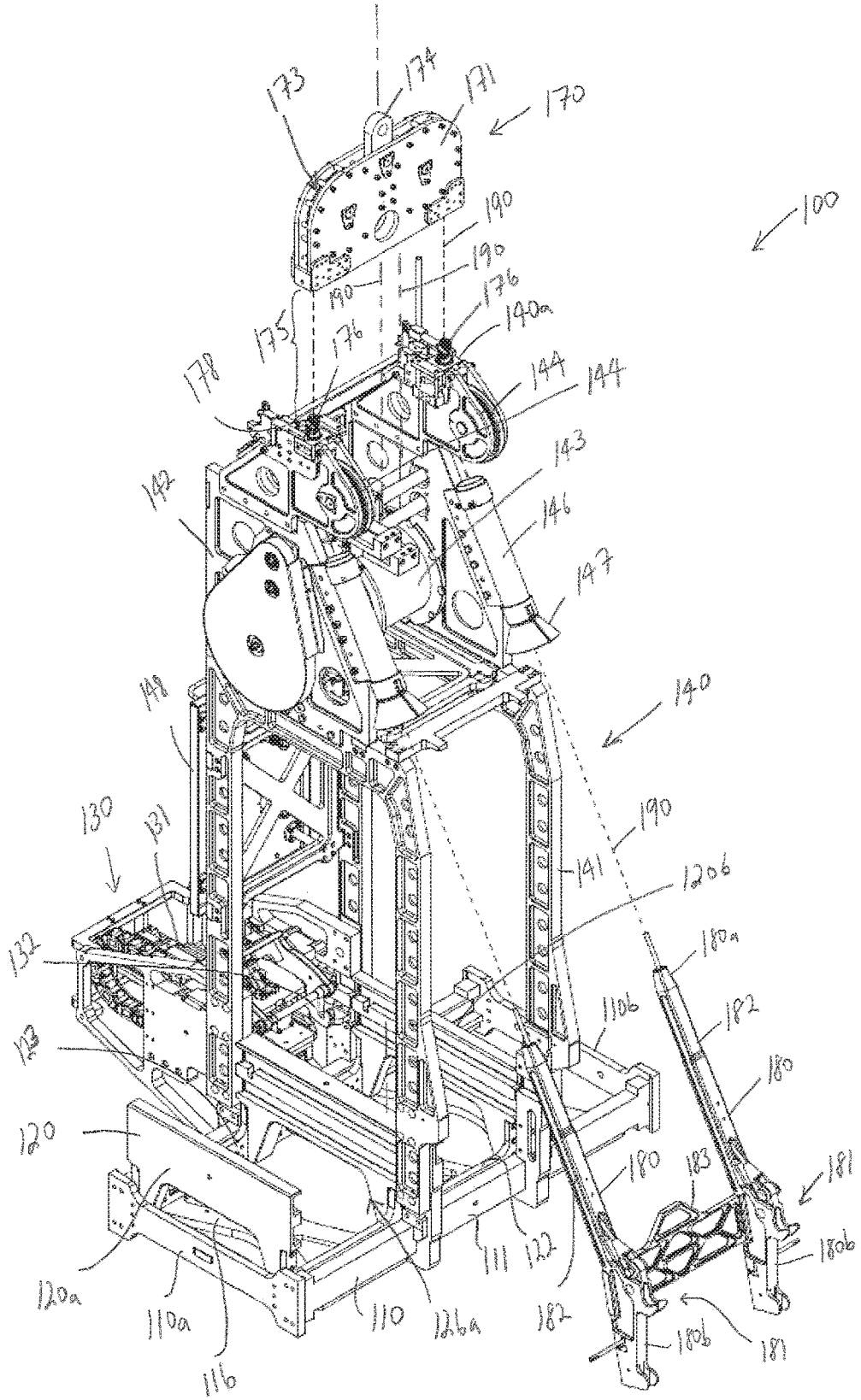
FIG. 7 is a perspective front view of the control pod exchange device of FIG. 2 and an embodiment of an alignment device for aligning the control pod exchange device with the BOP stack of FIG. 1.
Figure 8:
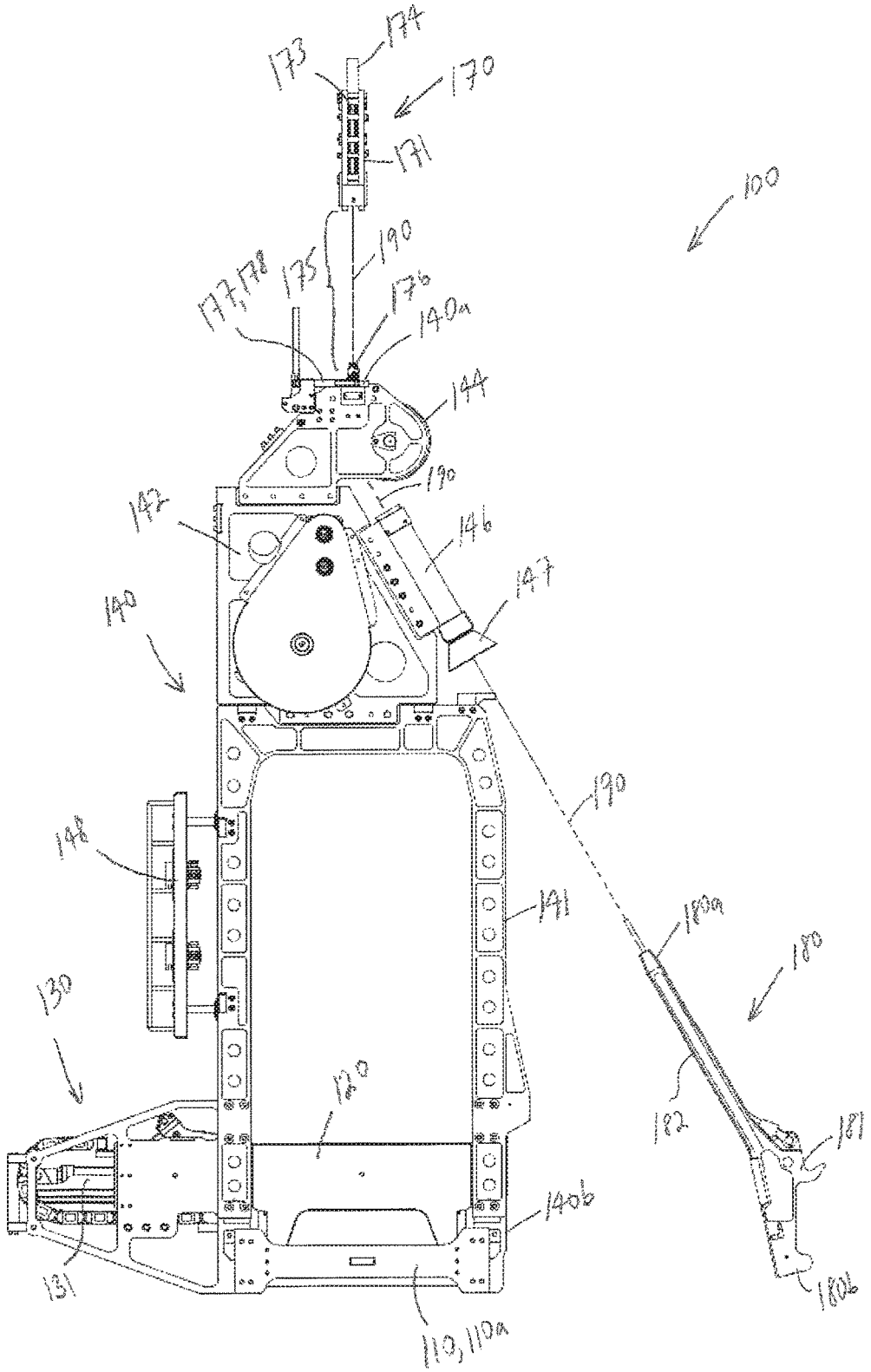
FIG. 8 is a side view of the control pod exchange device of FIG. 2 and an embodiment of an alignment device for aligning the control pod exchange device with the BOP stack of FIG. 1.

In this embodiment, connector assembly 170 is releasably coupled to housing 140 with a pair of connectors 175. As best shown in FIGS. 7 and 8, each connector 175 includes a stabbing member 176 extending from the upper end 140*a* of housing 140 and a sleeve (not visible) rotatably disposed within the bottom of body 171. Members 176 are sized to be slidingly received into the sleeves. In addition, the outer surface of each member 176 includes a recess extending circumferentially around each member 176 and comprising a plurality of interconnected, slopped camming surfaces, and the inner surface of each sleeve is provided with a pin that slidably moves through the corresponding recess as it is guided by the camming surfaces. The recesses are include a plurality of circumferentially-spaced apexes and a plurality of circumferentially-spaced access passages extending to the upper ends of members 176. One inlet/outlet passages is circumferentially positioned between each pair of circumferentially-adjacent apexes. Thus, when pins are disposed in the apexes of recesses, connector assembly 170 is slightly spaced above upper end 140*a* of housing 140, but connector assembly 170 and housing 140 cannot be pulled apart. However, by pushing connector assembly 170 and housing 140 together, pins slide downward through the recesses of members 176 as guided by the camming surfaces into the inlet/outlet passages. Subsequently pulling connector assembly 170 and housing 140 apart will allow pins to slide through the inlet/outlet passages out of recesses, thereby allowing disengagement and separation of connector assembly 170 and housing 140. To reconnect housing 140 and connector assembly 170, members 176 are aligned with and advanced into the sleeves of connector assembly 170. As members 176 are move into the sleeves, the pins are guided into and down the inlet/outlet passages by the camming surfaces of the recesses. As connector assembly 170 and housing 140 are pushed together, the pins move to the bottom of the inlet/outlet passages. After pushing connector assembly 170 and housing 140 together, subsequently pulling housing 140 and connector assembly 170 apart results in the camming surfaces guiding the pins into the apexes of the recesses, thereby preventing connector assembly 170 and housing 140 from being pulled further apart. In the manner described, housing 140 and connector assembly 170 are coupled with connectors 175 by pushing housing 140 and connector assembly 170 together to advance the pins through the inlet/outlet passages and subsequently moving them slightly apart to move the pins in the recess apexes; and housing 140 and connector assembly 170 are decoupled (after being coupled) by pushing housing 140 and connector assembly 170 together to move the pins out of apexes and subsequently pulling them apart to allow the pins to exit the recesses via the inlet/outlet passages.

Figure 3:
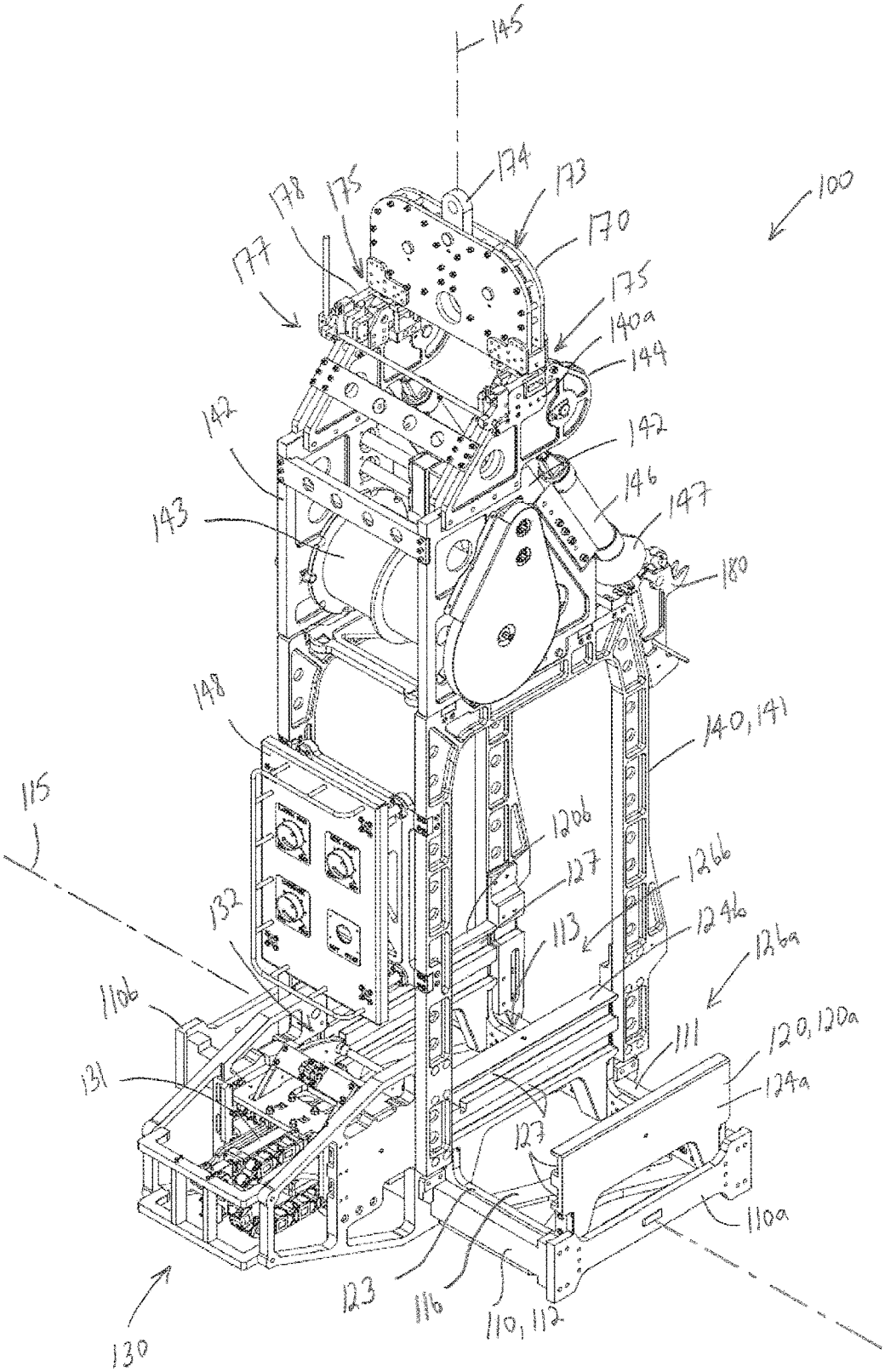
FIG. 3 is a perspective rear view of the control pod exchange device of FIG. 2.

As best shown in FIGS. 3, 4, and 8, in this embodiment, device 100 includes a manual lock 177 for releasably preventing connector assembly 170 and housing 140 from being pushed together once they are coupled with connectors 175. As previously described, once housing 140 and connector assembly 170 are coupled, they can only be decoupled by pushing housing 140 and connector assembly 170 together to move the pins out of apexes and into the inlet/outlet passages. However, by preventing housing 140 and connector assembly 170 from being moved together, lock 177 prevents the decoupling of connector assembly 170 and housing 140 once coupled together. In this embodiment, lock 177 includes a pair of elongate chocks 178 that can be manually wedged into the gap between connector assembly 170 and upper end 140*a* of housing 140 to prevent housing 140 and connector assembly 170 from being moved together, and manually pulled from the gap between housing 140 and connector assembly 170 to allow housing 140 and connector assembly 170 to be moved together.

A through passage extends through each connector 175 and has a central axis oriented tangent to the corresponding sheaves 144, 173. As will be described in more detail below, two flexible wirelines or cables 190 (shown with dashed lines in FIGS. 7 and 8) extend from winch 143. Each cable 190 extends over one sheave 173 of connector assembly 170, through the corresponding sleeve in body 171, through the passage in the corresponding connector 175, and under one sheave 144 of housing 140 to the upper end of one spear 180 slidably disposed in one guide 146. By paying out cables 190 with winch 143, spears 180 can be pulled from guides 146 and away from housing 140 as cables 190 pass through guides 146, and by paying in cables 190 with winch 143, cables 190 are pulled through guides 146 as spears 180 are pulled toward and into guides 146.

Referring now to FIGS. 7 and 8, each spear 180 has an upper end 180*a* and a lower end 180*b*. Lower end 180*b* comprises a connection member 181 sized and shaped to releasably connect to the outer frame of the BOP stack 11 (or a connection frame attached to the BOP stack 11). An elongate stabbing member 182 extends from connection member 181 to end 180*a* and has a tapered, frustoconical outer surface at end 180*a*. In this embodiment, spears 180 are fixably coupled together with a rigid cross-member 183.

Referring now to FIGS. 9A-9K, an embodiment of a system 200 for retrieving a failed or faulty control pod 30', and replacing it with a replacement control pod 30" is schematically shown. More specifically, in FIGS. 9A-9E, system 200 is shown delivering replacement control pod 30" subsea to BOP stack 11; in FIGS. 9E and 9F, system 200 is shown removing the failed or faulty control pod 30' from BOP stack 11 and replacing it with control pod 30"; and in FIGS. 9G-9K, system 200 is shown retrieving control pod 30' to vessel 20 at the surface 17.

In this embodiment, system 200 includes lifting device 22 mounted to surface vessel 20, rigging 50 coupled to lifting device 22, and control pod exchange device 100. In this embodiment, rigging 50 is rope that extends from lifting device 22 and can be paid in or paid out from lifting device 22 to raise or lower loads. As used herein, the term "rope" may be used to refer to any flexible type of rope including, without limitation, wire rope, cable, synthetic rope, or the like. Using lifting device 22 and rigging 50, control pod exchange device 100 delivers replacement pod 30" to BOP stack 11, automates the exchange of pods 30',30" (i.e., removes pod 30' from stack 11 and installs pod 30" in stack 11), and delivers pod 30' to the surface 17. Spears 180, guides 146, and cables 190 facilitate the alignment of device 100 relative to BOP stack 11, the coupling of device 100 to BOP stack 11 such that pods 30',30" can be exchanged, and the movement of device 100 to and away from BOP stack 11.

In this embodiment, one or more subsea remotely operated vehicles 40 are used, to varying degrees, to assist in the retrieval of pod 30' and deployment of pod 30". Each ROV 40 includes an arm 41 having a claw 42, a subsea camera 43 for viewing the subsea operations (e.g., the relative positions of LMRP 15, BOP 14, pods 30, 31, the positions and movement of arm 41 and claw 42, etc.), and an umbilical 44. Streaming video and/or images from cameras 43 are communicated to the surface or other remote location via umbilical 44 for viewing on a continuous live basis. Arms 41 and claws 42 are controlled via commands sent from the surface through umbilical 44.

Figure 9A:
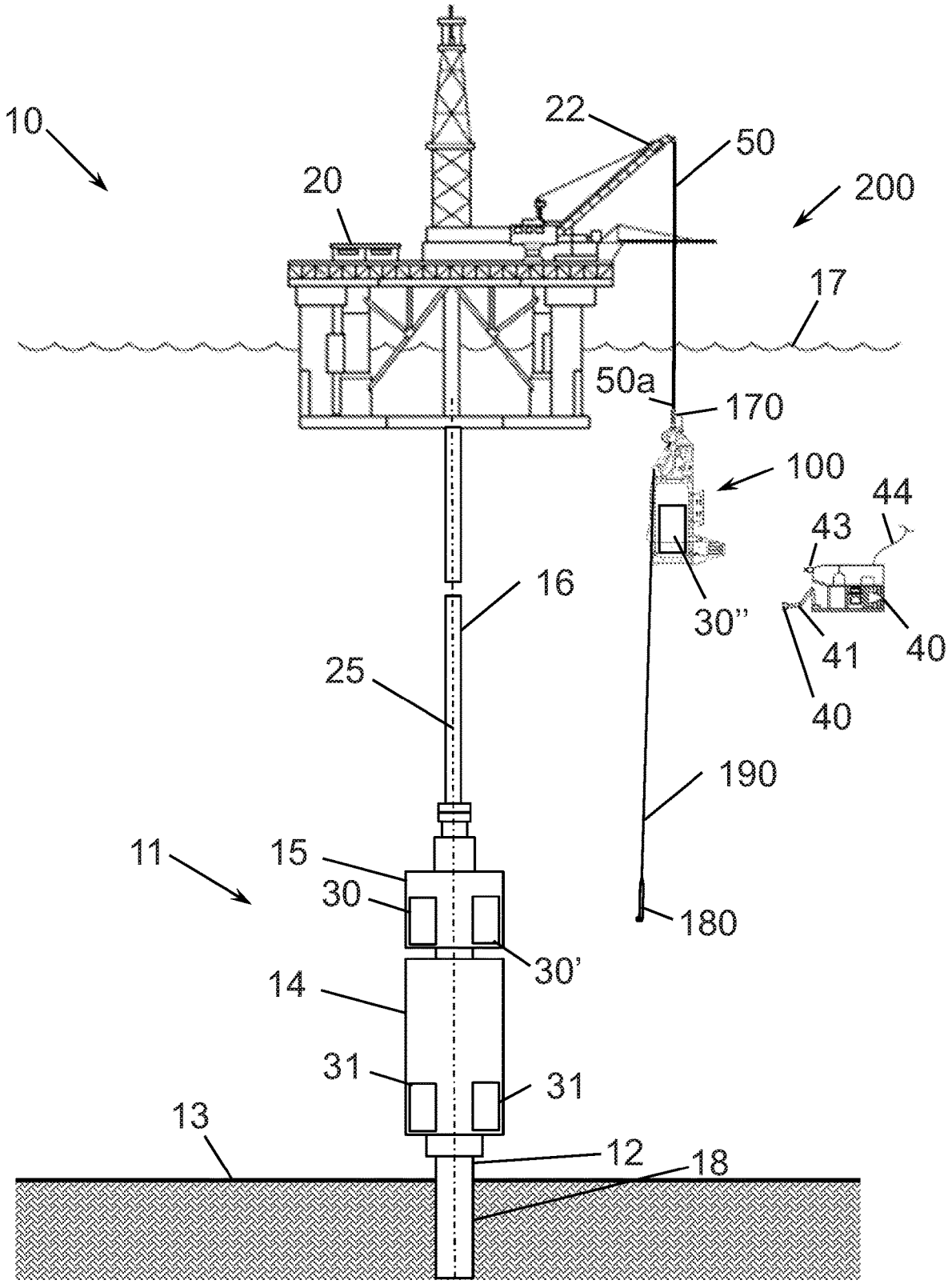
FIGS. 9A-9K are schematic views of an embodiment of a system and associated method in accordance with the principles described herein for replacing a control pod of the offshore system of FIG. 1 with the control pod exchange device of FIG. 2.

FIGS. 9A-9K illustrate an embodiment of a method for replacing control pod 30' with control pod 30" using system 200 will be described. Referring first to FIG. 9A, control pod 30" is disposed within exchange device 100 on vessel 20. In particular, pod 30" is positioned in one stall 126*a*, 126*b* of trolley 120, and the free end 50*a* of cable 50 is attached to connector 174 of device 100 with device 100 disposed on vessel 20. The stall 126*a*, 126*b* within which pod 30" is positioned is preferably aligned with middle bay 117*b* to balance the weight of device 100 with pod 30" therein. In addition, connector assembly 170 is coupled to housing 140 with connectors 175. Next, lifting device 22 lowers exchange device 100 (carrying pod 30") subsea via cable 50. As shown in FIG. 9A, cables 190 are paid out from winch 143 at the surface 17 (e.g., aboard vessel 20) such that spears 180 are hung from exchange device 100 with cables 190 once device 100 is disposed subsea.

Figure 9B:
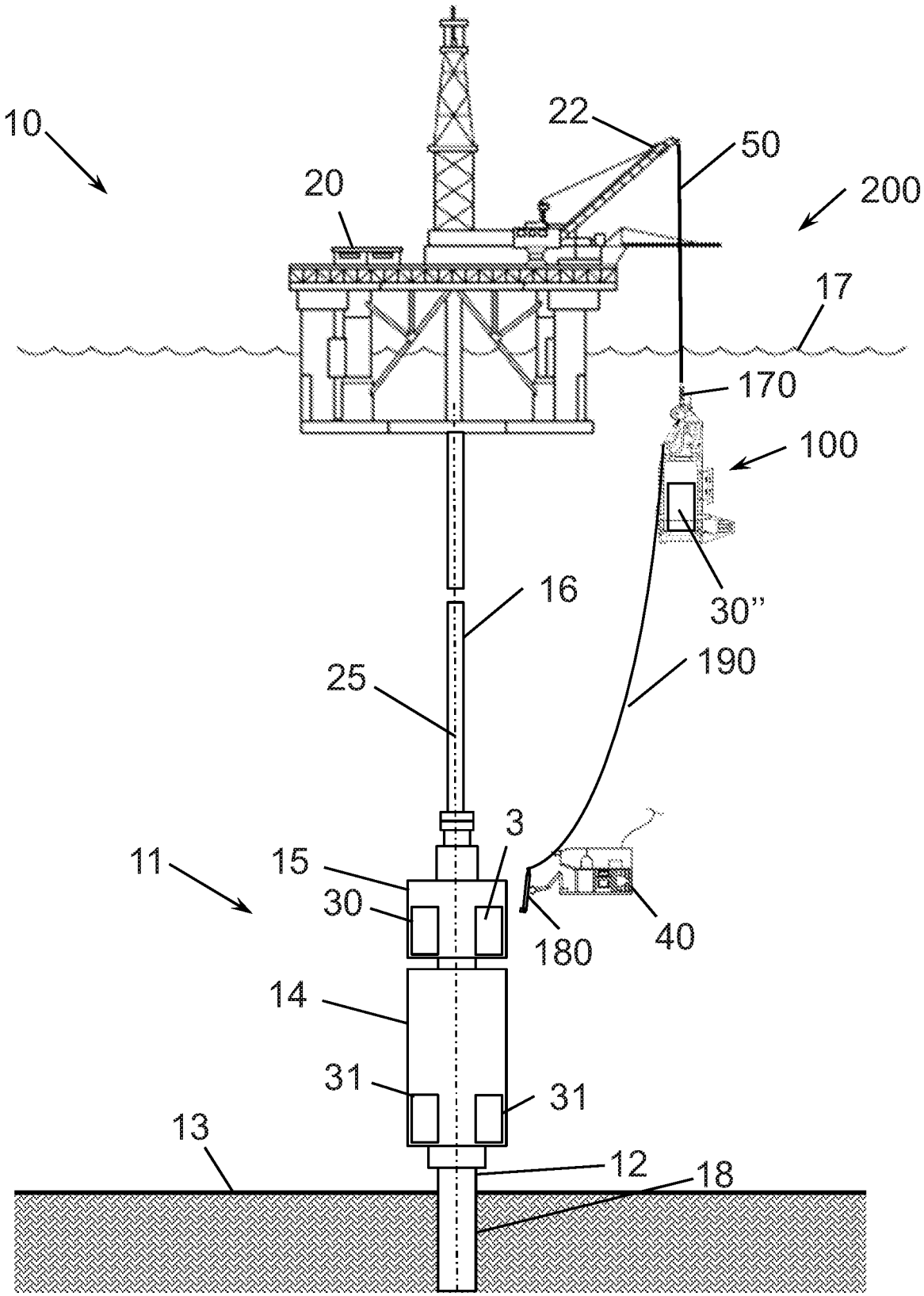

Moving now to FIG. 9B, cables 190 are preferably paid out from winch 143 at the surface 17 such that spears 180 are lowered to a depth equal to or greater than the depth of control pod 30' as exchange device 100 is lowered subsea from vessel 20 with lifting device 22. Next, spears 180 are attached to BOP stack 11 with ROV 40. In particular, BOP stack coupling members 181 are releasably connected to the outer frame of the BOP stack 11 (or a connection frame attached to the BOP stack 11). As a result, stabbing members 182 extend upward from BOP stack 11 at a position and orientation that aligns middle bay 117*b* with pod 30' when received by guides 146 upon arrival of exchange device 100.

Figure 9C:
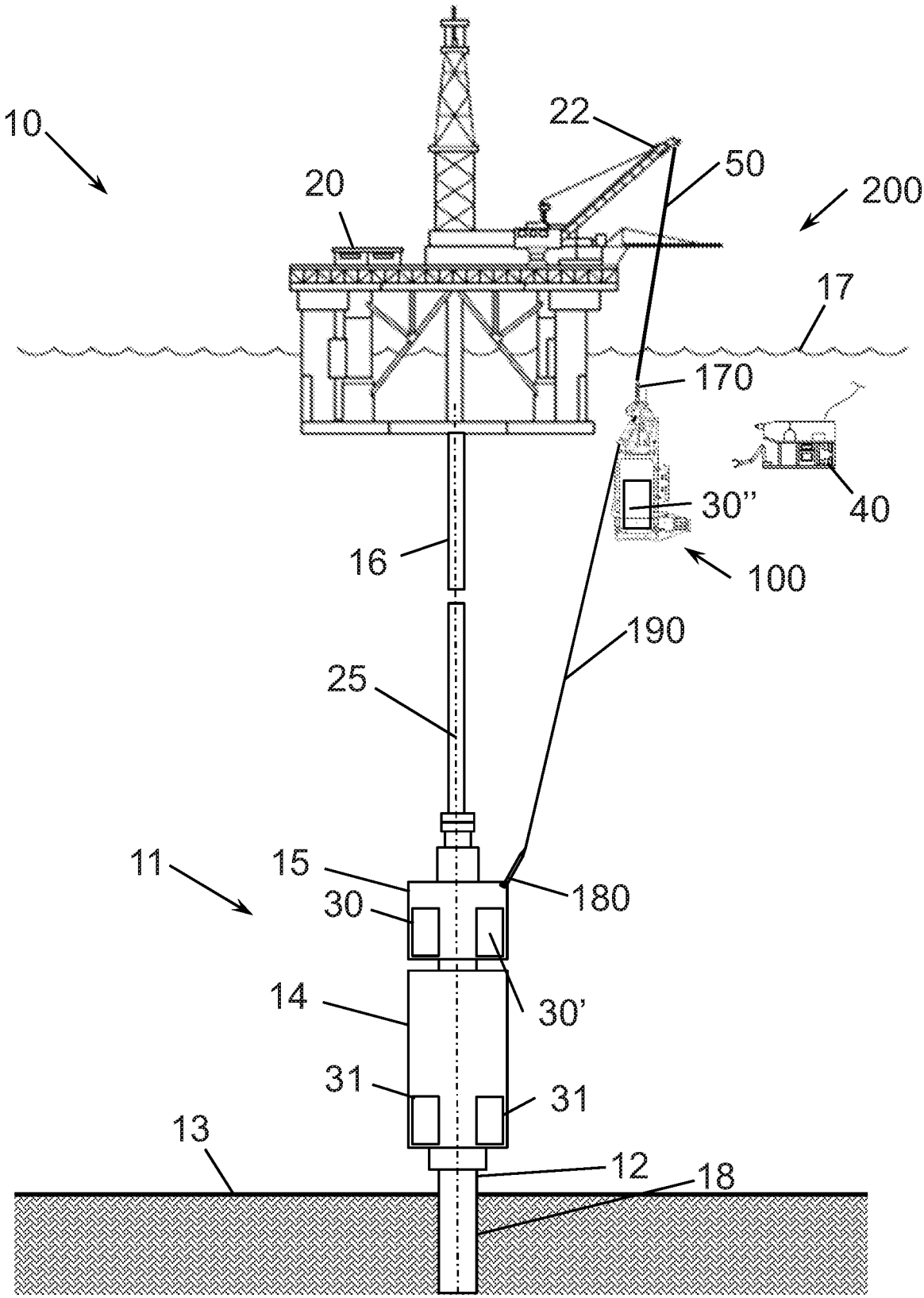

Referring now to FIG. 9C, once spears 180 are attached to BOP stack 11, lifting device 22 pays in cable 50 to pull any slack from cables 190, resulting in tension being applied to cables 190 and cable 50. Next, lifting device 22 applies sufficient tension to cable 50 to pull housing 140 and connector assembly 170 together, thereby transitioning connectors 175 from the locked position to the unlocked position. The tension applied to cable 50 is subsequently reduced with lifting device 22, thereby decoupling and lowering housing 140 from connector assembly 170.

Figure 11:
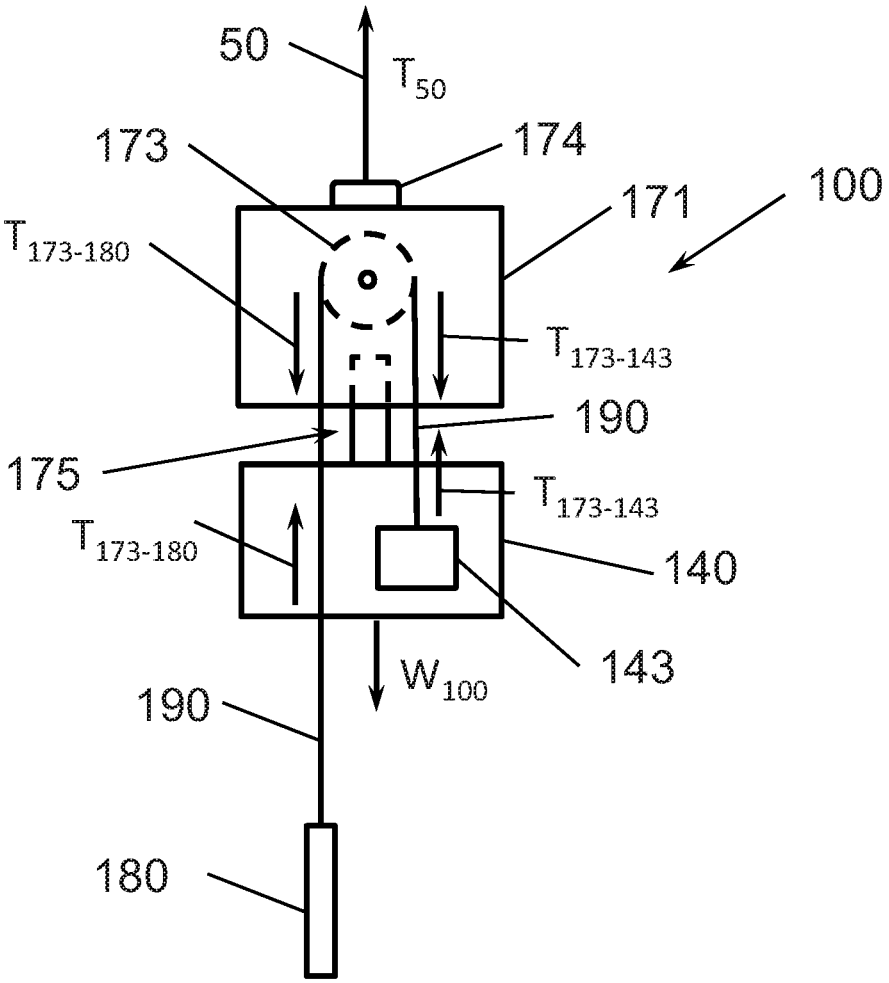
FIG. 11 is a schematic view of the loads applied to the releasably connector of FIG. 9C under static conditions.

Referring briefly to FIG. 11, a schematic free body diagram of the forces applied to housing 140 and connector assembly 170 under generally static conditions are shown. For purposes of clarity and simplicity, sheaves 173, cables 190, spears 180, and connectors 175 are represented by a single sheave 173, a single cable 190, a single spear 180, and a single connector 175, respectively, in FIG. 11. The weight of exchange device 100 (including any pod 30 disposed thereon) is represented with reference numeral "$W_{110}$," the tension in cable 50 is represented with reference numeral "$T_{50}$," the tension in the portion of cable 190 extending between sheave 173 and spear 180 is represented with reference numeral "$T_{173\text{-}190}$," and the tension in the portion of cable 190 extending between sheave 173 and winch 143 is represented with reference numeral "$T_{173\text{-}143}$." Under static conditions, when there is no tension in cable 190 (i.e., $T_{173\text{-}180}=0$ and $T_{173\text{-}143}=0$), the forces applied to connector 175 include the weight $W_{100}$ acting through housing 140 and the tension $T_{50}$ acting through connector assembly 170. However, with spears 180 secured to BOP stack 11, tension $T_{50}$ is applied to cable 50 translates into tension applied to cable 190 (tensions $T_{173\text{-}190}$, $T_{173\text{-}143}$). When the tension $T_{50}$ applied to cable 50 by lifting device is equal to twice the weight $W_{100}$, the downward force acting on connector 175 due to weight $W_{100}$ is offset and balanced by tension $T_{173\text{-}143}$ applied to housing 140 by cable 190, and the upward force acting on connector 175 due to tension $T_{50}$ is offset and balanced by the sum of tensions $T_{173\text{-}180}$, $T_{173\text{-}143}$. Thus, by applying a tension $T_{50}$ to cable 50 with lifting device 22 that is greater than twice the weight $W_{100}$ (i.e., "over pulling" cable 50), housing 140 is lifted upward to connector assembly 170, thereby transitioning connector 175 from the locked position to the unlocked position. Subsequently reducing the tension $T_{50}$ in cable 50 with lifting device will lower housing 140 relative to connector assembly 170, thereby decoupling housing 140 and connector assembly 170. The foregoing relationships between the tension $T_{50}$ in cable 50, the tension $T_{173\text{-}180}$, $T_{173\text{-}143}$ in cables 190, and the weight $W_{100}$ of exchange device 100 can be utilized to control and time the decoupling of connector assembly 170 and housing 140 from the surface 17 with lifting device 22.

Figure 9D:
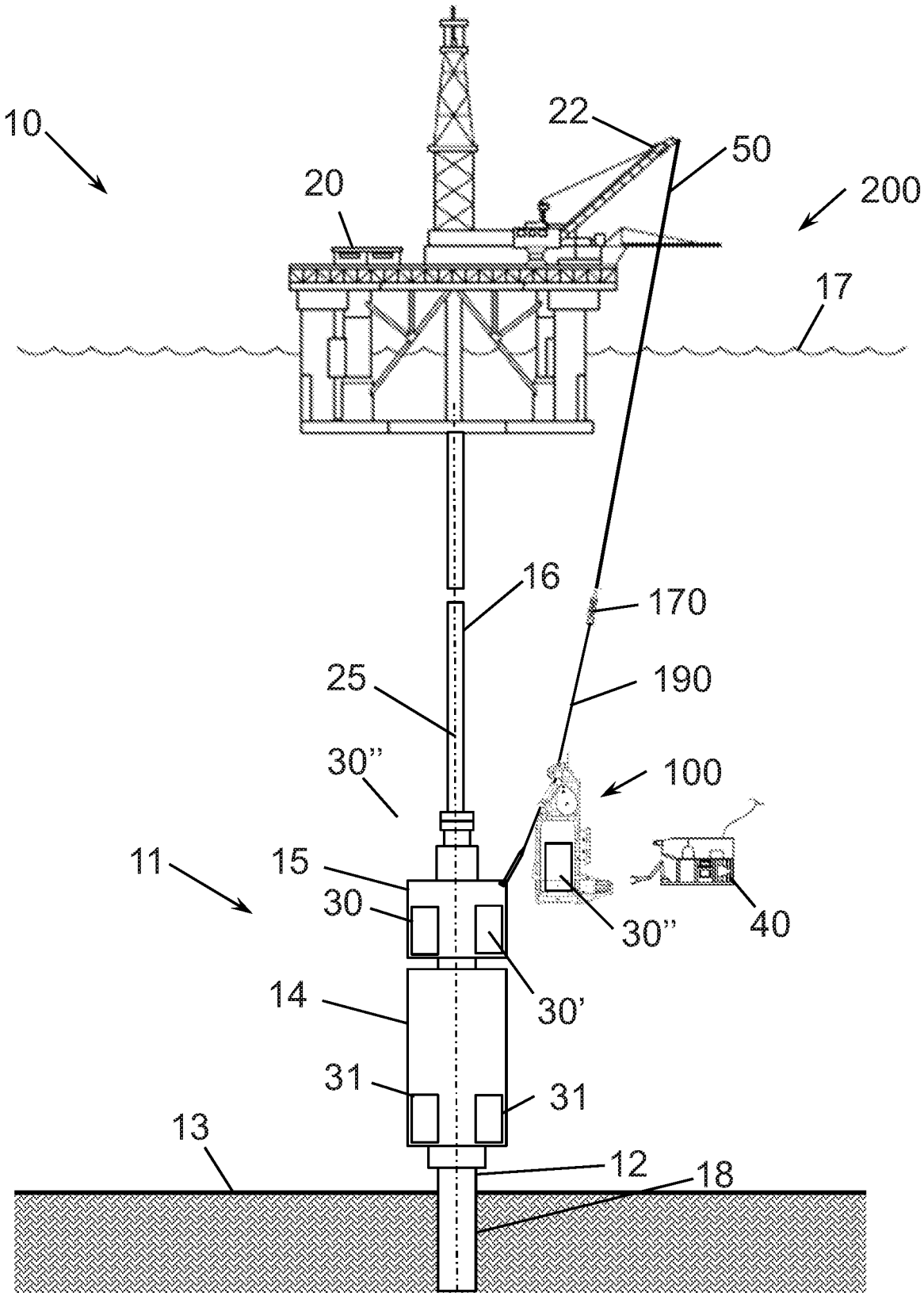
Figure 9E:
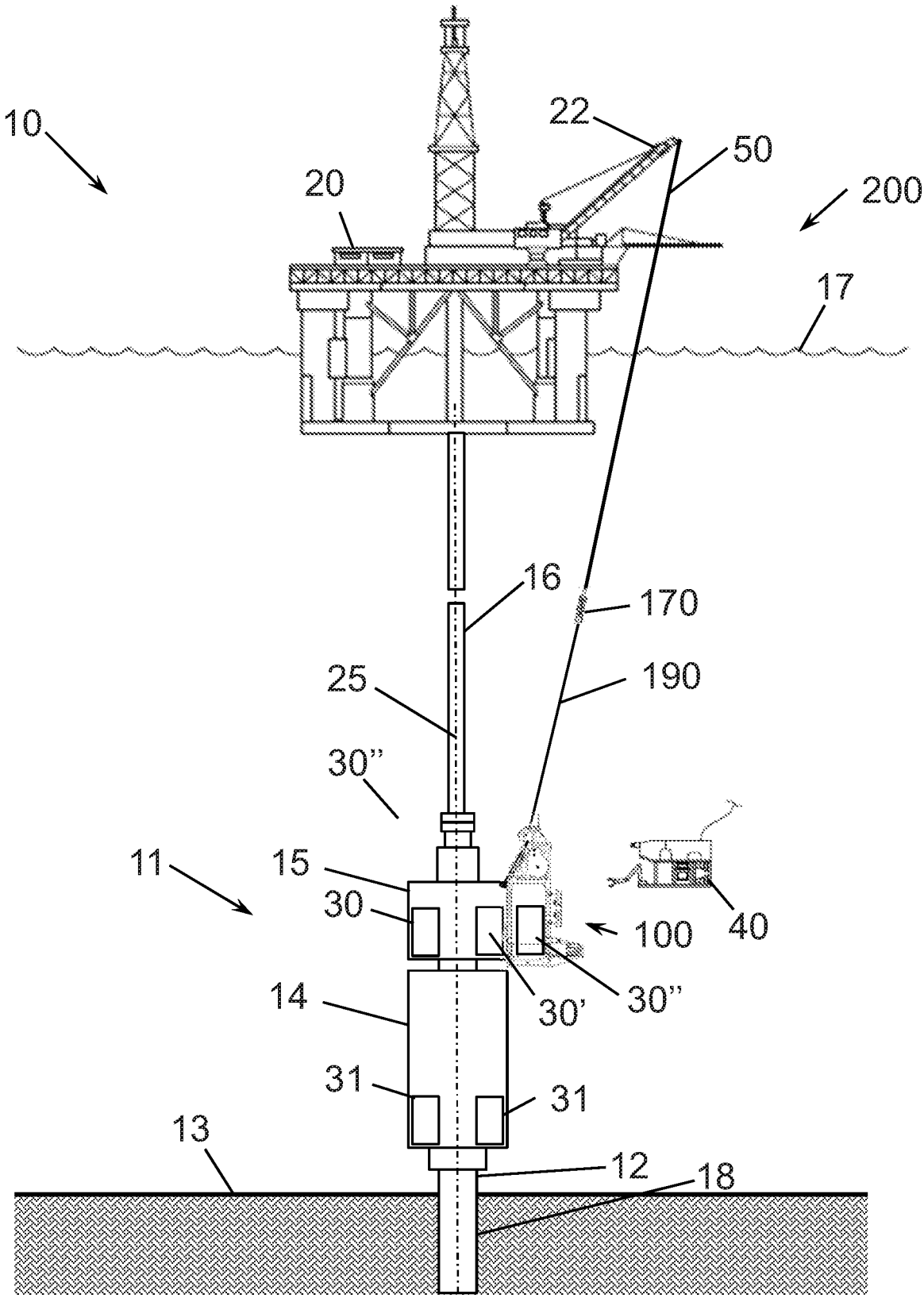

Moving now to FIGS. 9D and 9E, upon decoupling of connector assembly 170 and housing 140, housing 140 and base 110 mounted thereto are lowered by paying out cable 50 from lifting device 22. It should be appreciated that connector assembly 170 is spaced from housing 140 and remains attached to cable 50 during this process. As cable 50 is paid out, cables 190 move around sheaves 173, pass through connectors 175 and the corresponding sleeves, and pass under sheaves 144 as housing 140 slides along cables 190 extending through guides 146 towards spears 180 and BOP stack 11. As housing 140 and base 110 approach BOP stack 11, spears 180 are slidingly received into guides 146, thereby aligning middle bay 117*b* in the desired position relative to BOP stack 11 (i.e., with bay 117*b* adjacent to control pod 30').

Figure 9F:
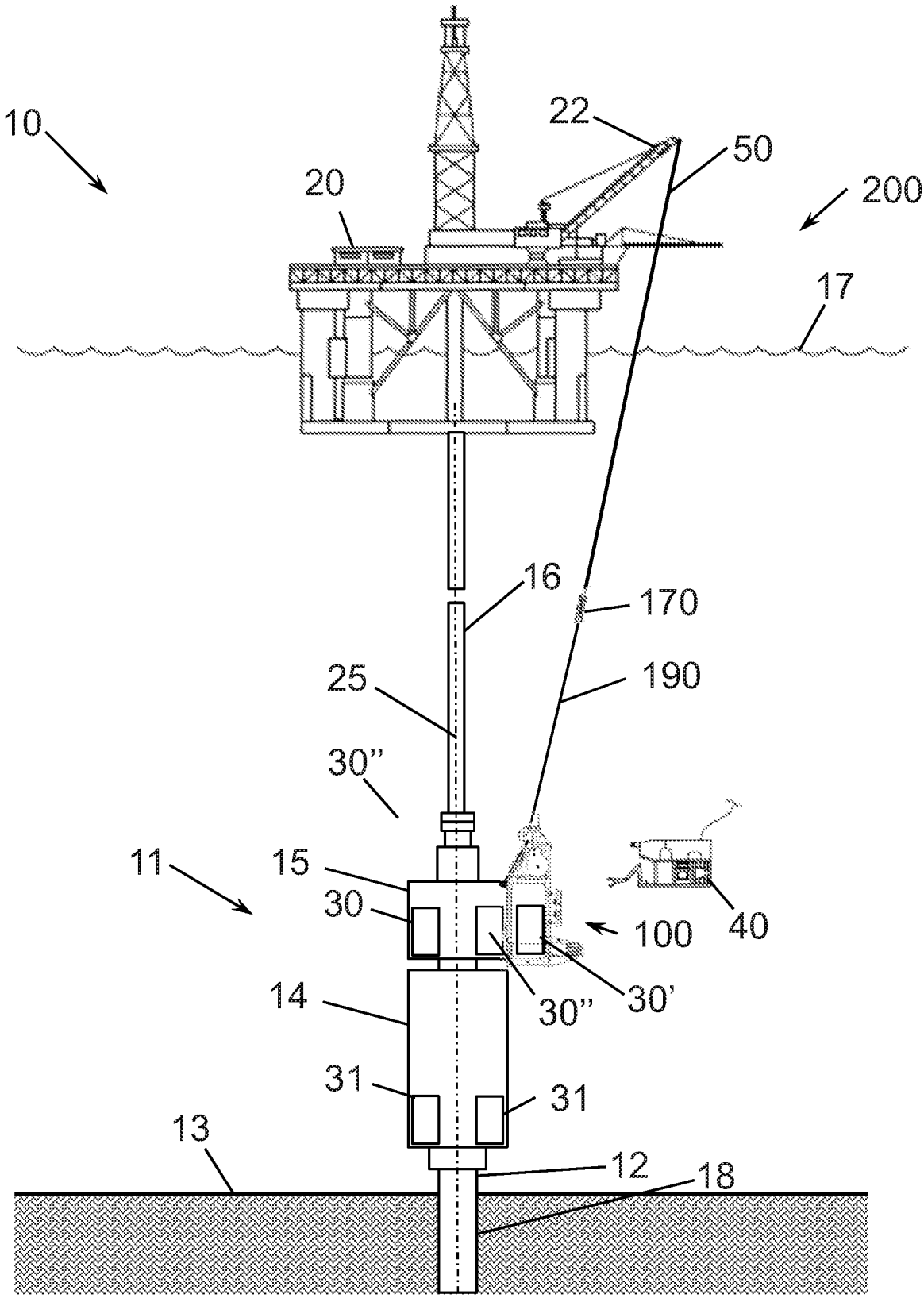

As shown in FIGS. 9E and 9F, once housing 140 is coupled to BOP stack 11 with middle bay 117*b* aligned with and adjacent the control pod 30', trolley 120 and actuation assembly 130 are used to exchange pods 30',30" (i.e., pod 30' is replaced with pod 30"). In this embodiment, pod 30' is first removed from BOP stack 11, and then, pod 30" is installed in BOP stack 11.

Figure 10A:
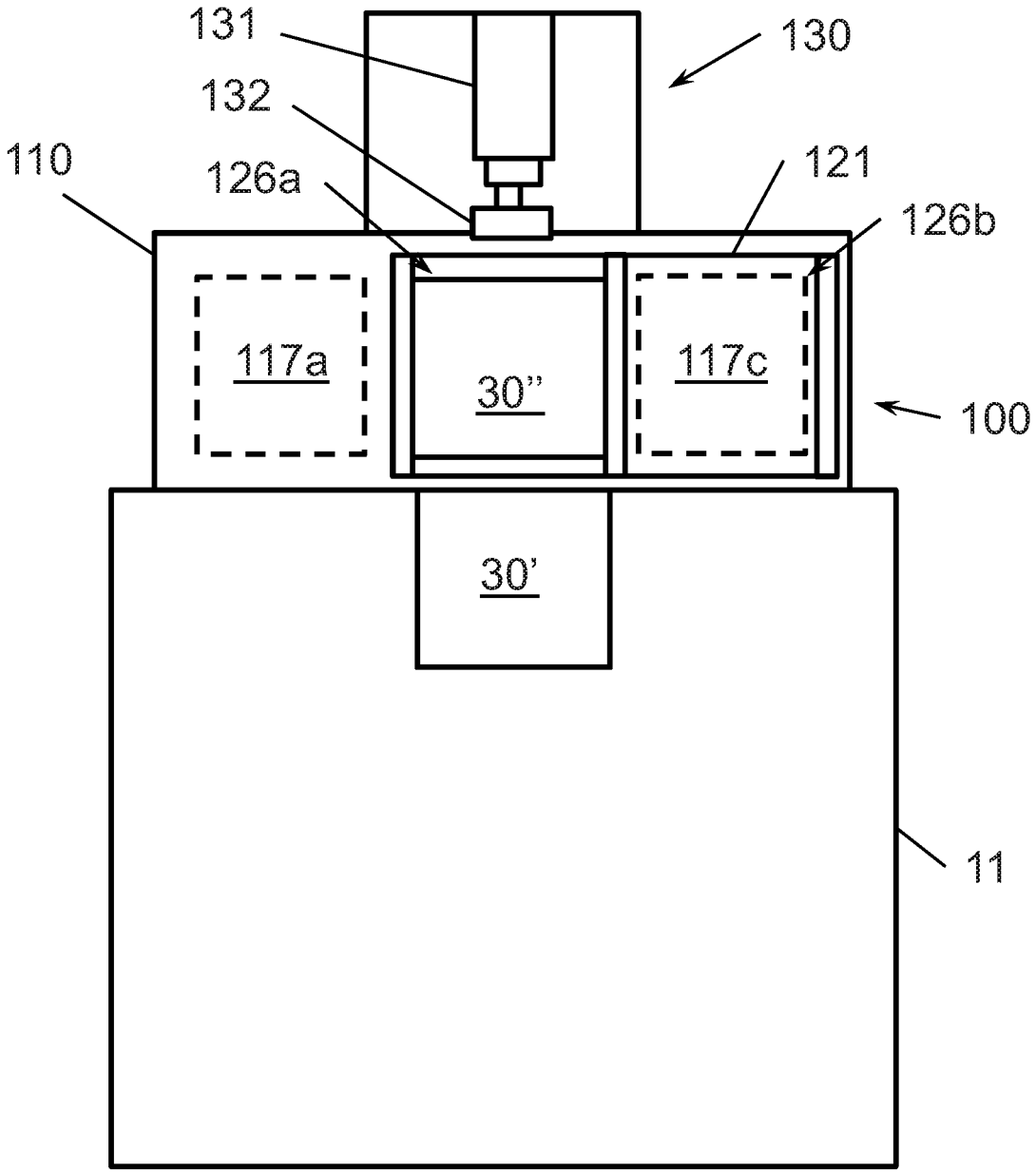
FIGS. 10A-10F are schematic top views of the control pod transfer device exchanging control pods with the BOP stack as shown in FIGS. 9E and 9F.
Figure 10B:
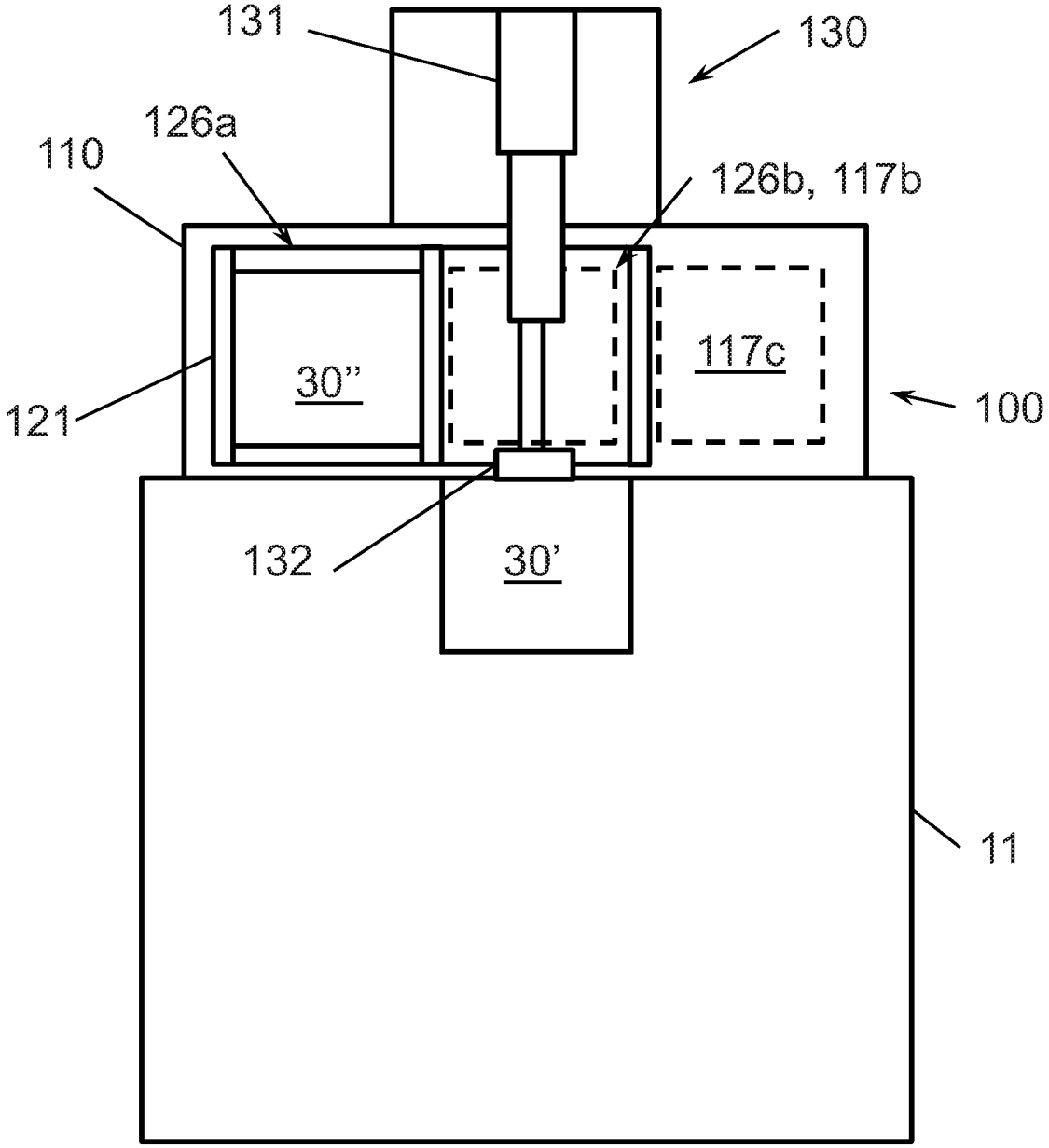
Figure 10C:
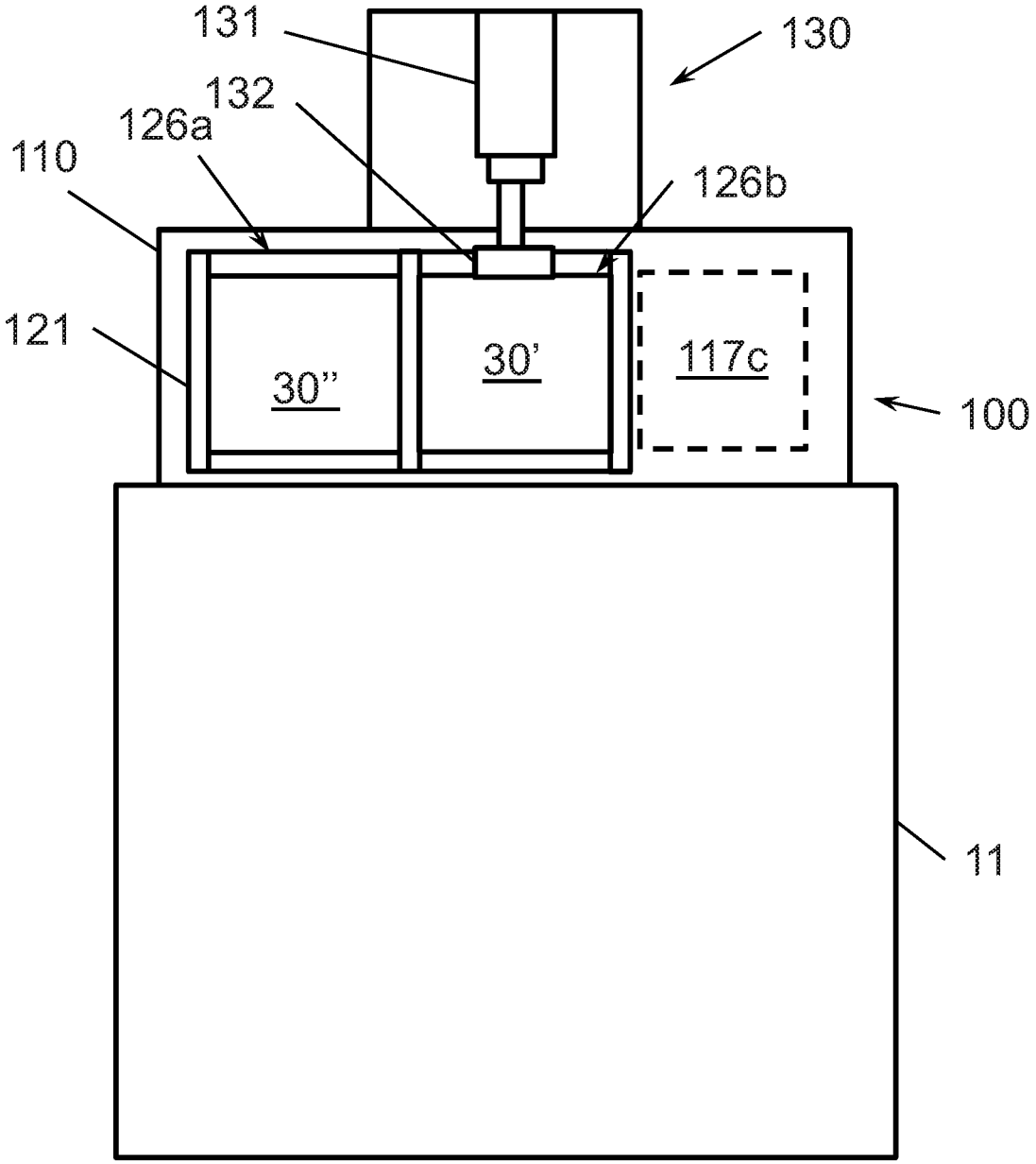
Figure 10D:
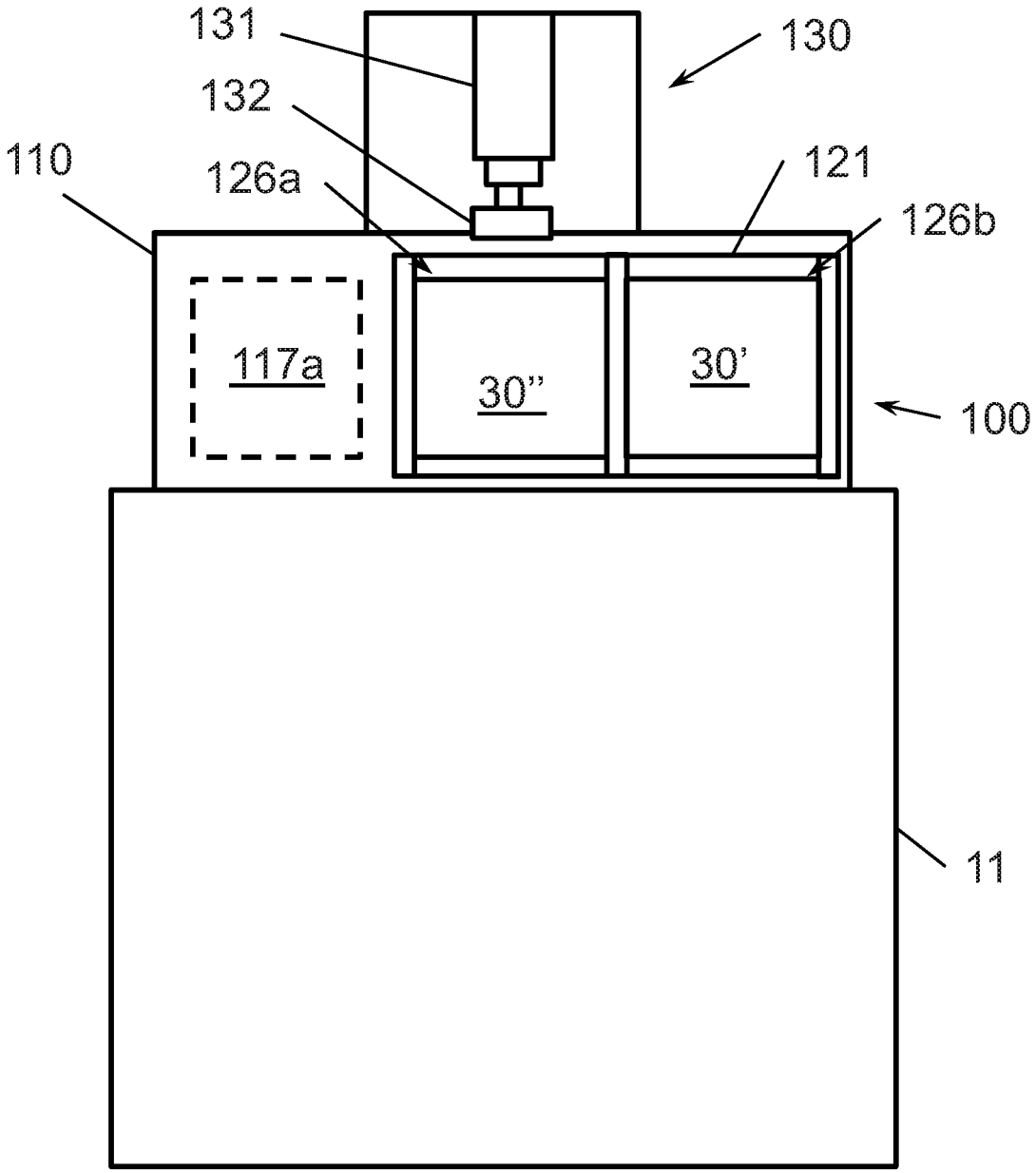
Figure 10E:
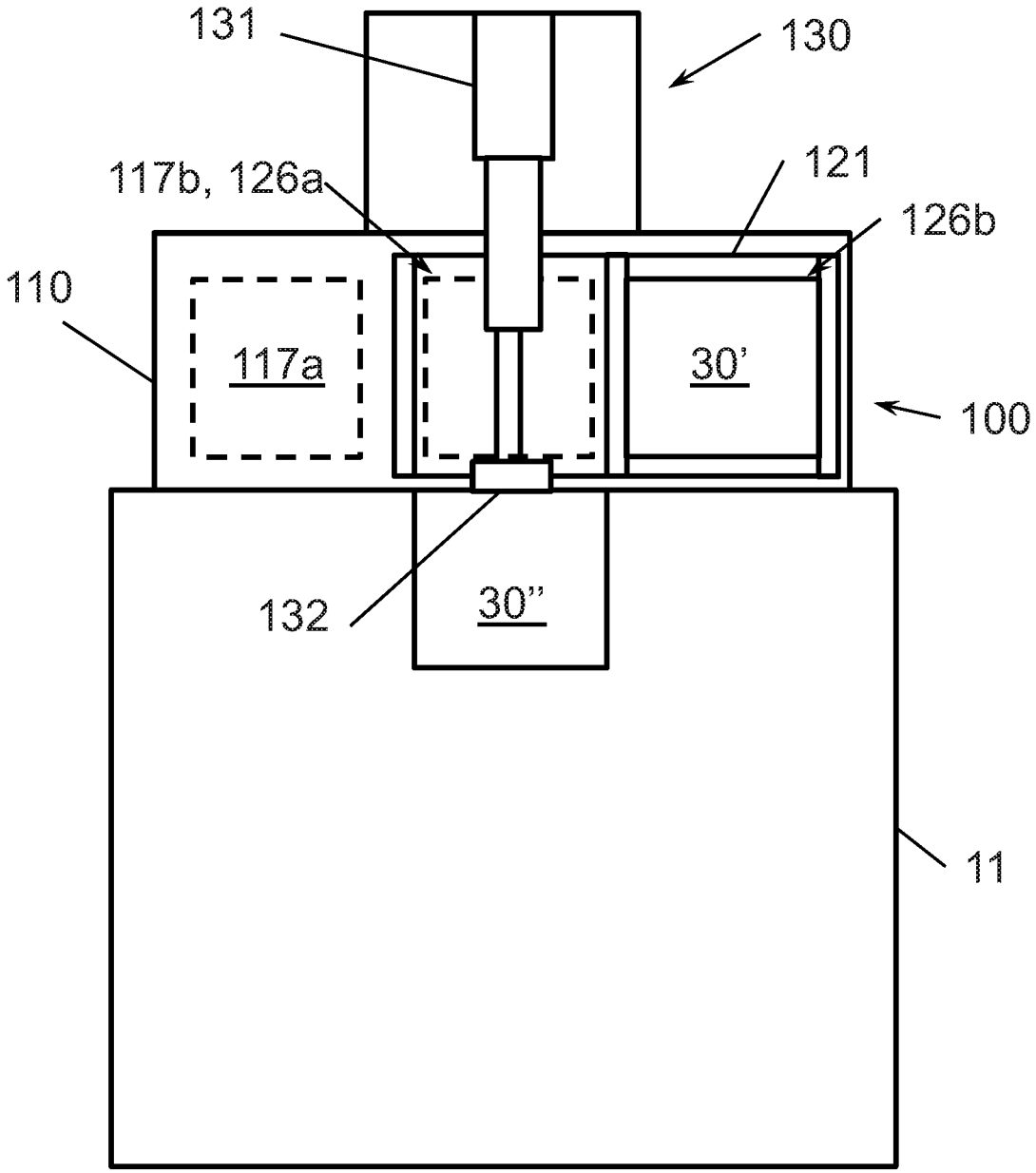
Figure 10F:
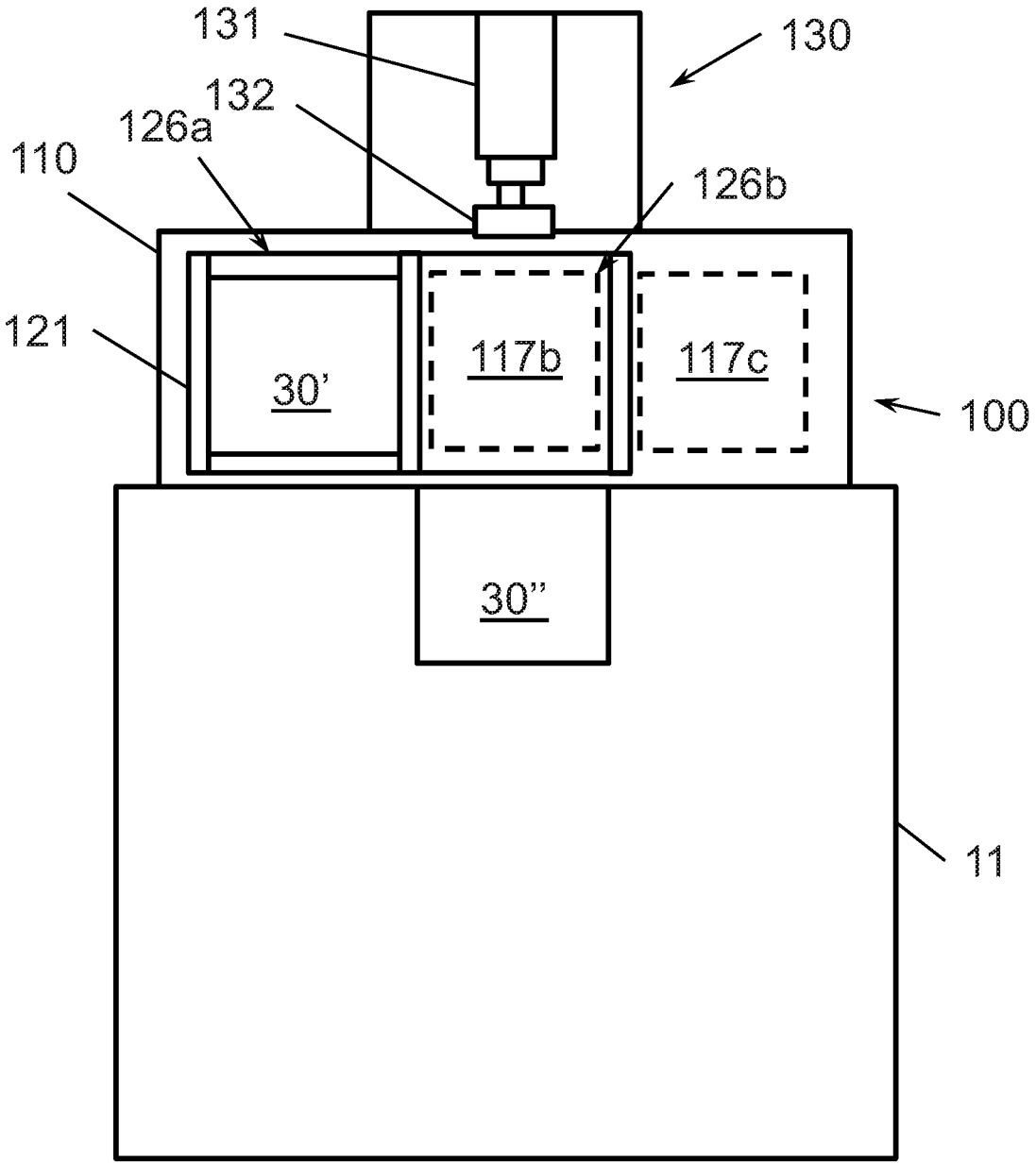

The detailed steps for exchanging pods 30',30" after housing 140 is coupled to BOP stack 11 is schematically shown in FIGS. 10A-10F. Referring first to FIGS. 10A and 10B, trolley 120 is translated in base 110 with actuation assembly 130 to move replacement control pod 30" out of middle bay 117*b* and align the empty stall 126*a*, 126*b* with control pod 30'. In this embodiment, pod 30" is positioned in stall 126*a* on vessel 20, and thus, trolley 120 is translated to move pod 30" from middle bay 117*b* to bay 117*a* while simultaneously moving empty stall 126*b* from bay 117*c* to middle bay 117*b*. Next, as shown in FIGS. 10C and 10D, actuator 131 is extended through middle bay 117*b* and interface assembly 132 positively engages pod 30". Next, actuator 131 retracts to pull pod 30" from BOP stack 11 into middle bay 117*b* and stall 126*b* aligned therewith. ROV 40 can be used to decouple any connections between pod 30' and BOP stack 11 (e.g., mechanical and/or hydraulic connections between pod 30' to BOP stack 11) prior to pulling pod 30" from BOP stack 11. Moving now to FIG. 10D, with both pods 30',30" loaded in trolley 120, actuation assembly 130 translates trolley 120 relative to base 110 to move control pod 30' out of middle bay 117*b* and move replacement control pod 30" into middle bay 117*b*. Next, as shown in FIG. 10E, interface assembly 132 positively engages pod 30' and actuator 131 is extended through middle bay 117*b* to push pod 30' into BOP stack 11. ROV 40 can be used to make up any connections between pod 30" and BOP stack 11 (e.g., mechanical and/or hydraulic connections between pod 30' to BOP stack 11). Moving now to FIG. 10F, with replacement control pod 30" installed on BOP stack 11, interface assembly 132 disengages pod 30" and actuator 131 is withdrawn, thereby completing the exchange of pods 30',30". To balance the weight of housing 140 and base 110 following the installation of pod 30", trolley 120 is preferably translated with actuation assembly 130 to position pod 30' in middle bay 117*b*.

Figure 9G:
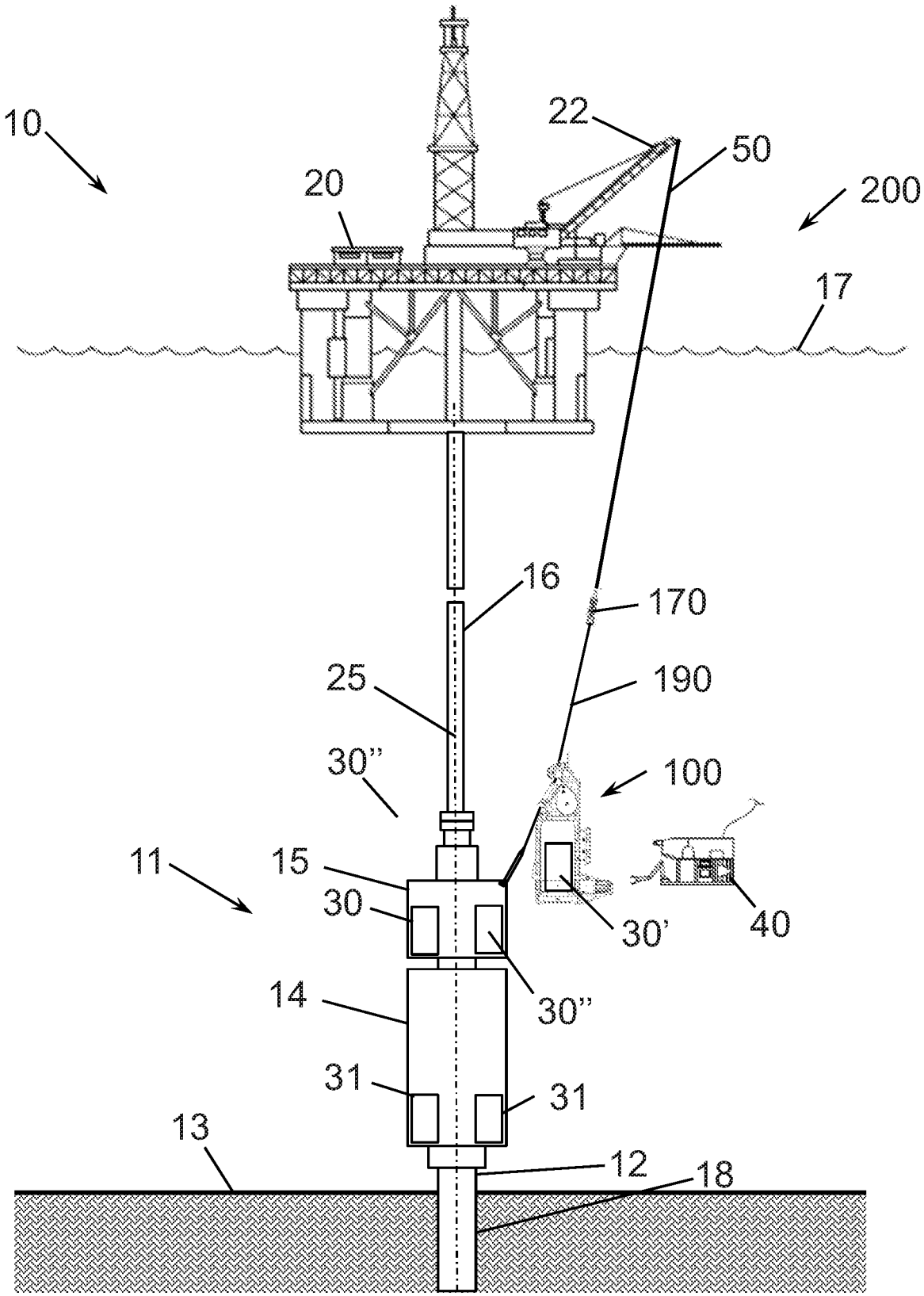
Figure 9H:
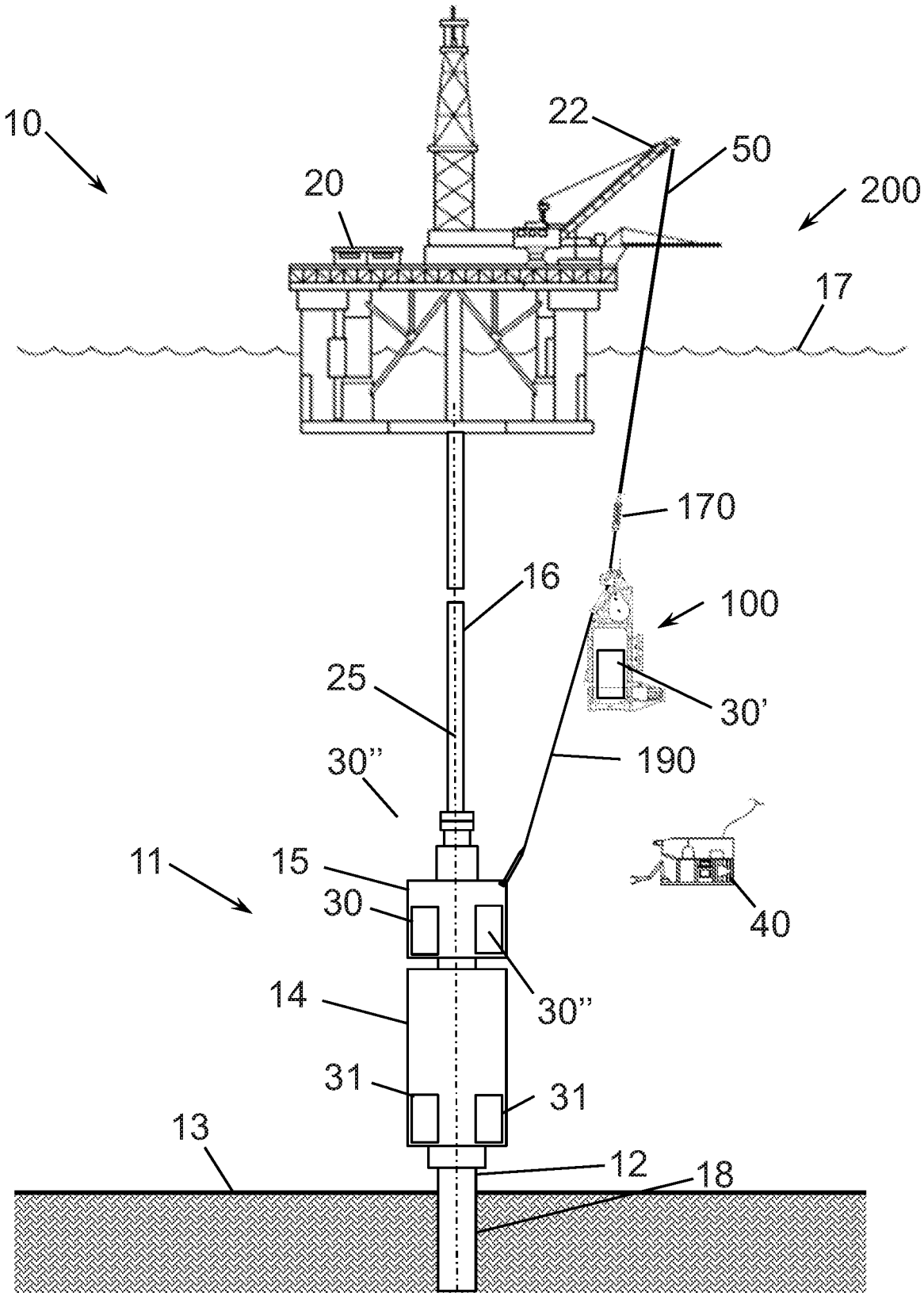

Referring now to FIGS. 9F-9H, after swapping pods 30',30", housing 140 and base 110 are lifted from BOP stack 11. In particular, lifting device 22 is operated to pay in cable 50, thereby pulling housing 140 (and base 110 attached thereto) upward toward the surface 17 and connector assembly 170. As cable 50 is paid in, cables 190 move around sheaves 173, pass through connectors 175 and the corresponding sleeves, and pass under sheaves 144 as housing 140 slides along cables 190 as housing 140 slides along cables 190 extending through guides 146 away from spears 180 and BOP stack 11.

Figure 9I:
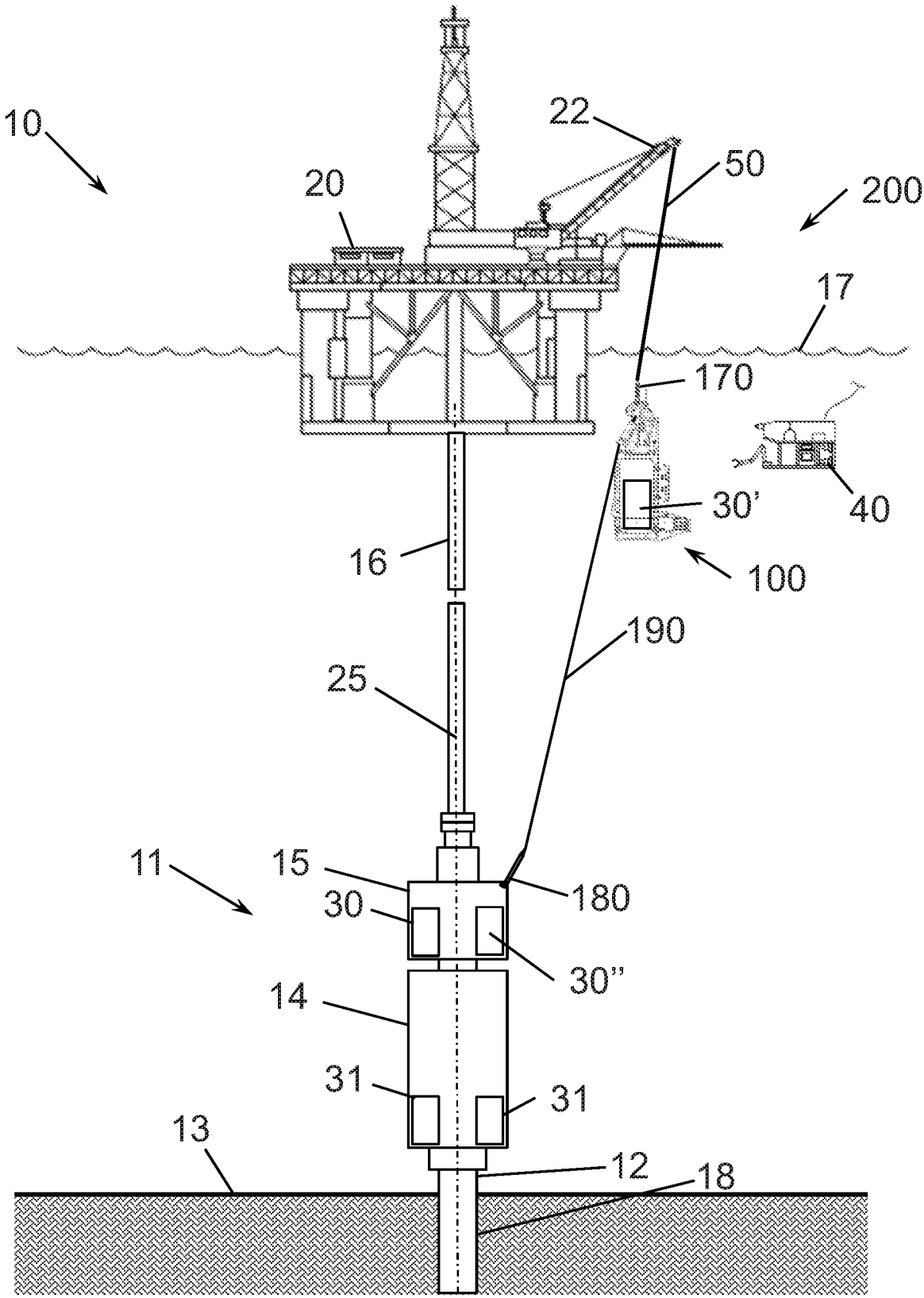

Moving now to FIG. 9I, upon arrival at connector assembly 170, stabbing members 176 on housing 140 are aligned with the mating sleeves in connector assembly 170. Lifting device 22 continues to pay in cable 50 to pull stabbing members 176 into the sleeves, and to pull housing 140 and connector assembly 170 together, thereby transitioning connectors 175 from the unlocked position to the locked position releasably coupling housing 140 and connector assembly 170 together.

Figure 9J:
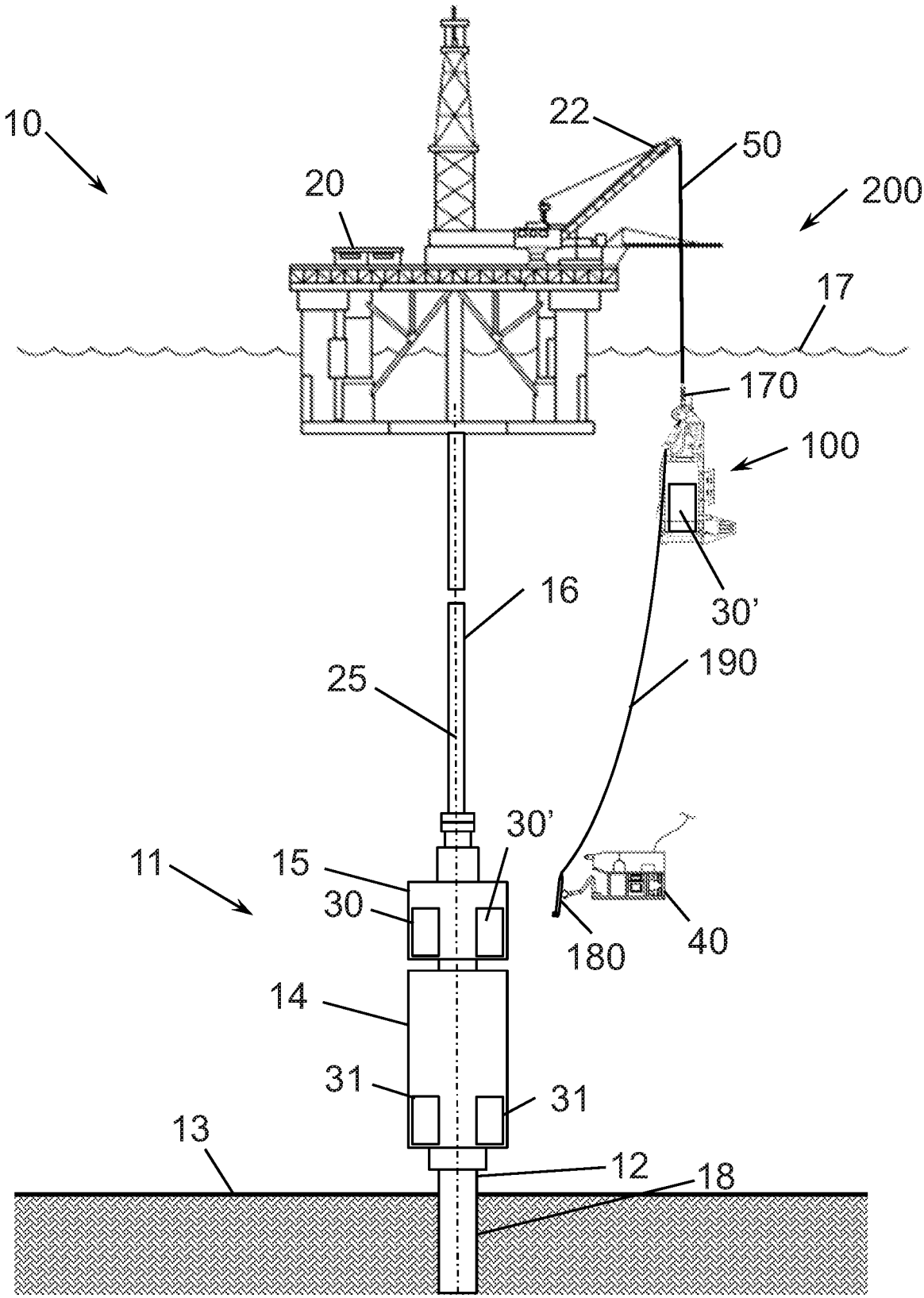
Figure 9K:
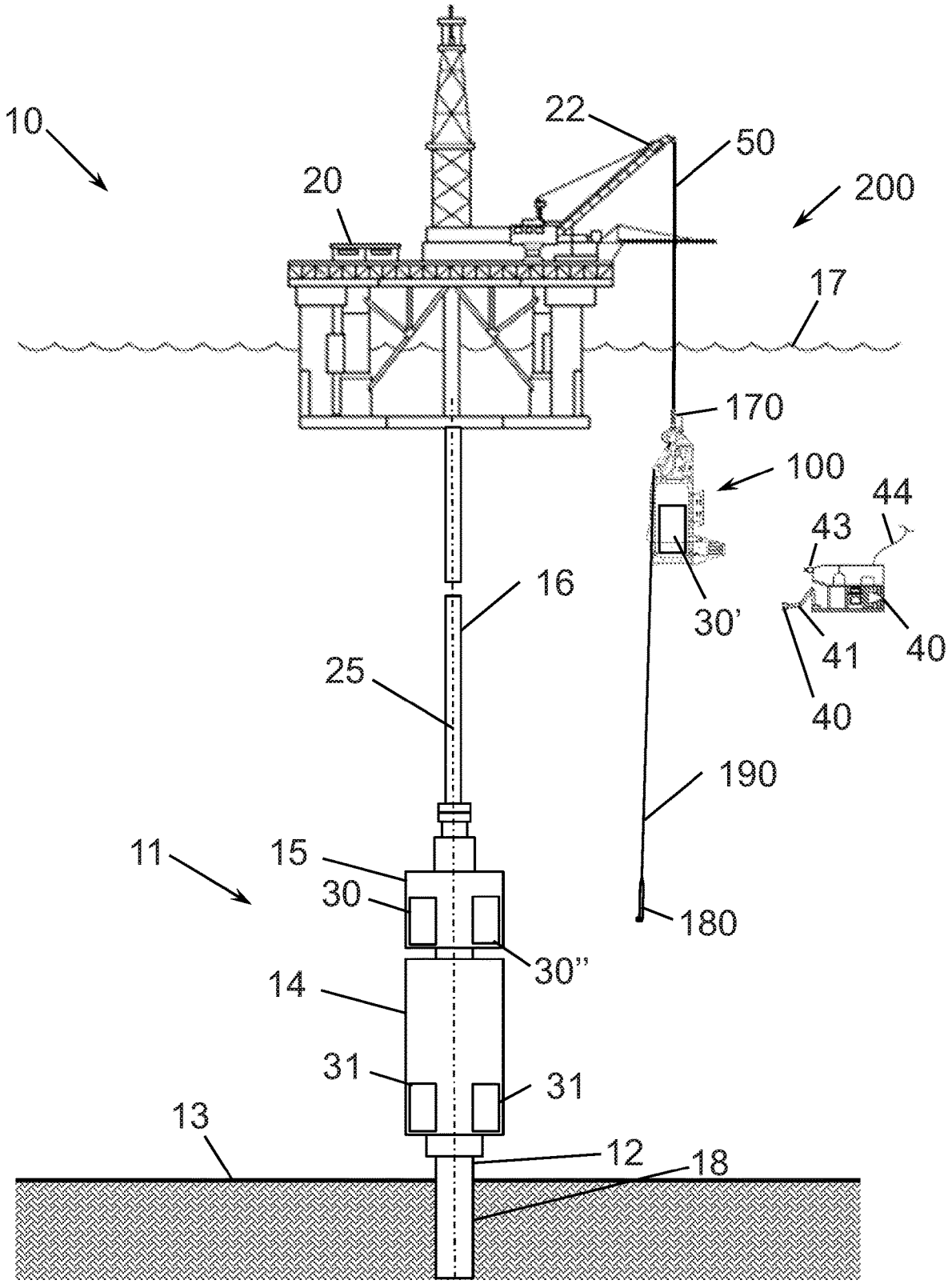

After coupling housing 140 and connector assembly 170, the weight of device 100 is supported by cable 50 while lifting device 22 is operated to pay out cable 50, thereby removing any tension in cables 190. Next, ROV 40 decouples spears 180 from BOP stack 11 as shown in FIG. 9J. At this point, winch 143 can be operated to pay in cables 190 and pull spears 180 upward to exchange device 100, or alternatively, cables 190 can be left hanging from exchange device 100 as lifting device 22 raises exchange device 100 (carrying pod 30') to vessel 20 as shown in FIG. 9K.

In the manner described and shown in FIGS. 9A-9K, system 200 can be used to deploy control pod 30", exchange or swap control pods 30',30" at BOP stack 11, and retrieve control pod 30' to the surface 17 in a single subsea trip. During deployment of pod 30" and retrieval of pod 30', lifting device 22 pays out and pays in cable 50 to move housing 140, which carries pods 30',30", to and from BOP stack 11. Thus, in this embodiment, control over the deployment and retrieval of exchange device 100 is primarily controlled from the surface with lifting device 22. For example, winch 143 need not be operated to lower and raise exchange device 100 to and from, respectively, BOP stack 11. In addition, ROV 40 can be used to guide and/or monitor exchange device 100 (and pod 30', pod 30" disposed thereon) as it is lifted, lowered, or otherwise moved subsea. However, it should be appreciated that during deployment of pod 30", exchanging of pods 30',30" at BOP stack 11, and retrieval of pod 30', the weight of exchange device 100 (and any pod 30',30" thereon) is supported by cable 50 and/or cables 190, thereby reducing the payload lifting requirements for ROV 40.

Referring now to FIGS. 12A-12K, an embodiment of a system 300 for retrieving a failed or faulty control pod 30', and replacing it with a replacement control pod 30" is schematically shown. More specifically, in FIGS. 12A-12E, system 300 is shown delivering replacement control pod 30" subsea to BOP stack 11; in FIGS. 12E and 12F, system 300 is shown removing the failed or faulty control pod 30' from BOP stack 11 and replacing it with control pod 30"; and in FIGS. 12G-12K, system 300 is shown retrieving control pod 30' to vessel 20 at the surface 17.

System 300 is similar to system 200 previously described with the exception that system 300 relies on a derrick 21' mounted to surface vessel 20 and pipe string 150 (e.g., a drill string) suspended from derrick 21' instead of lifting device 22 and rigging 50 to deploy and retrieve control pod exchange device 100. Thus, in this embodiment of system 300, using offset derrick 21' and pipe string 150, control pod exchange device 100 delivers replacement pod 30" to BOP stack 11, automates the exchange of pods 30',30" (i.e., removes pod 30' from stack 11 and installs pod 30" in stack 11), and delivers pod 30' to the surface 17. Spears 180, guides 146, and cables 190 facilitate the alignment of device 100 relative to BOP stack 11, the coupling of device 100 to BOP stack 11 such that pods 30',30" can be exchanged, and the movement of device 100 to and away from BOP stack 11. In this embodiment, one or more subsea remotely operated vehicles 40 as previously described are used, to varying degrees, to assist in the retrieval of pod 30' and deployment of pod 30".

Figure 12A:
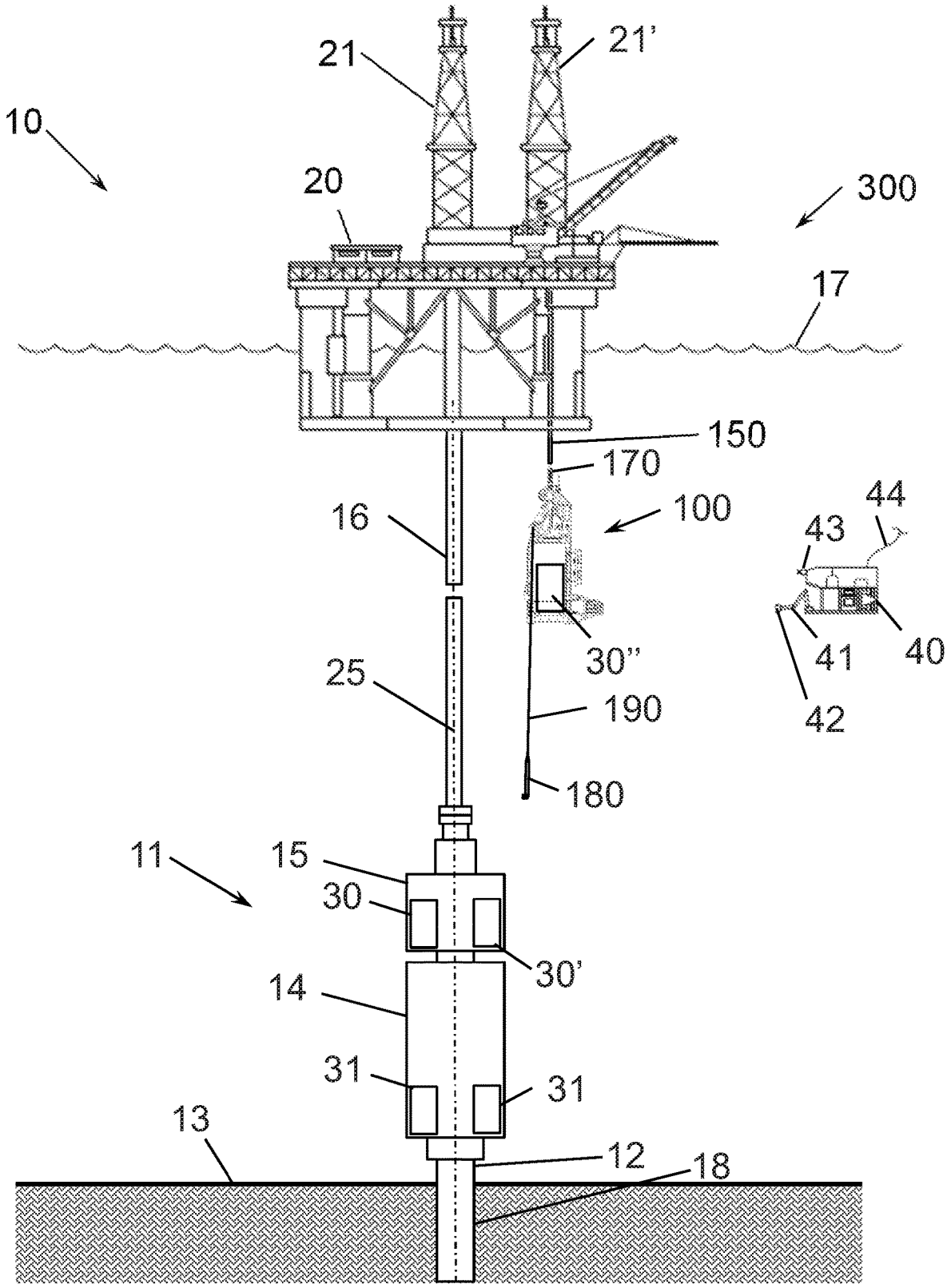
FIGS. 12A-12K are schematic views of an embodiment of a system and associated method in accordance with the principles described herein for replacing a control pod of the offshore system of FIG. 1 with the control pod exchange device of FIG. 2.

Referring first to FIG. 12A, control pod 30" is disposed within exchange device 100 on vessel 20. In particular, pod 30" is positioned in one stall 126*a*, 126*b* of trolley 120. The lower end of pipe string 150 is attached to connector assembly 170 of device 100 via 174 with device 100 disposed on vessel 20. The stall 126*a*, 126*b* within which pod 30" is positioned is preferably aligned with middle bay

117*b* to balance the weight of device 100 with pod 30" therein. In addition, connector assembly 170 is coupled to housing 140 with connectors 175. Next, derrick 21' lowers exchange device 100 (carrying pod 30") subsea via pipe string 150. As shown in FIG. 12A, cables 190 are paid out from winch 143 at the surface 17 (e.g., aboard vessel 20) such that spears 180 are hung from exchange device 100 with cables 190 once device 100 is disposed subsea.

Figure 12B:
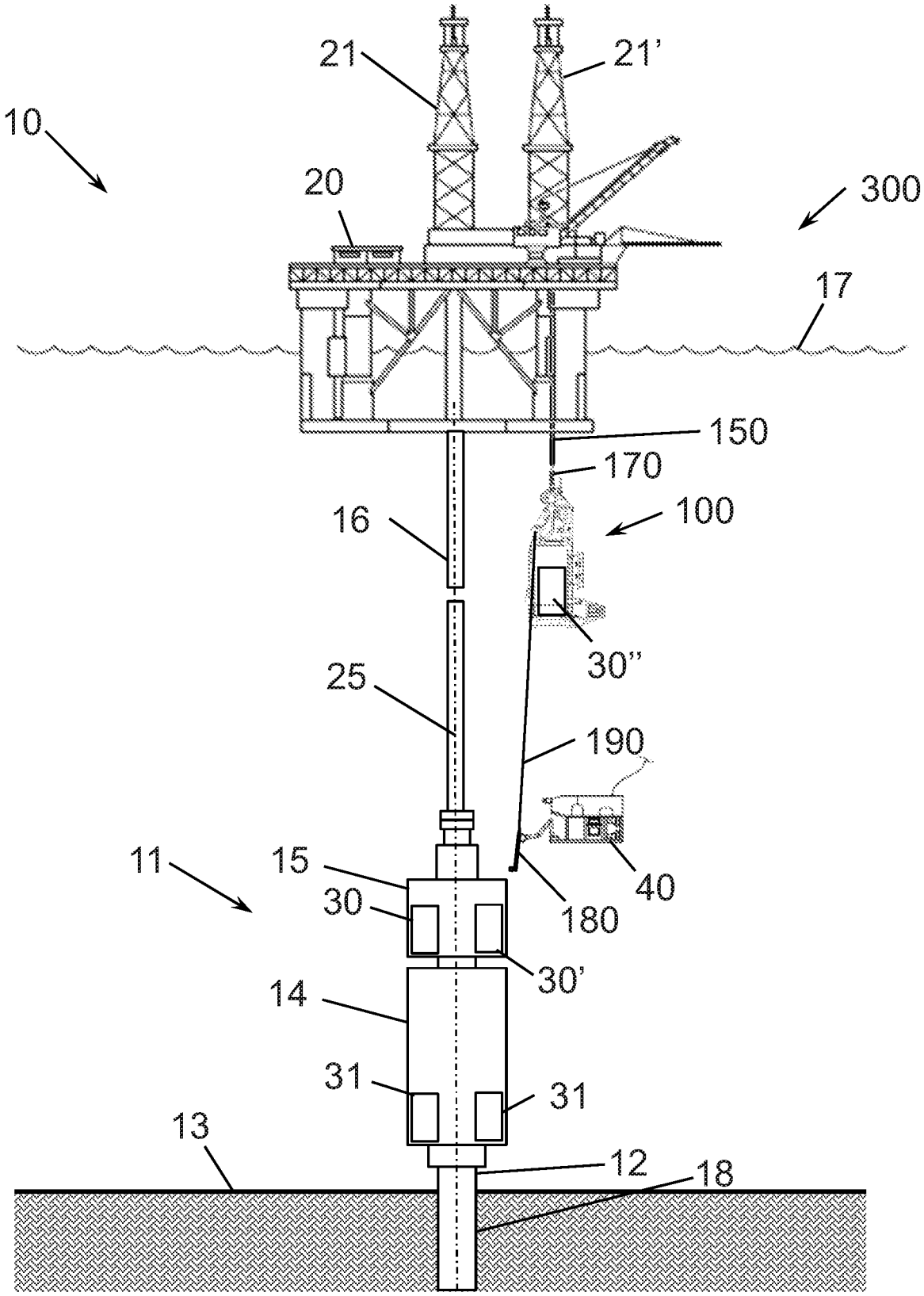

Moving now to FIG. 12B, cables 190 are preferably paid out from winch 143 at the surface 17 such that spears 180 are lowered to a depth equal to or greater than the depth of control pod 30' as exchange device 100 is lowered subsea from vessel 20 with lifting device 22. Next, spears 180 are attached to BOP stack 11 with ROV 40. In particular, BOP stack coupling members 181 are releasably connected to the outer frame of the BOP stack 11 (or a connection frame attached to the BOP stack 11). As a result, stabbing members 182 extend upward from BOP stack 11 at a position and orientation that aligns middle bay 117*b* with pod 30' when received by guides 146 upon arrival of exchange device 100.

Figure 12C:
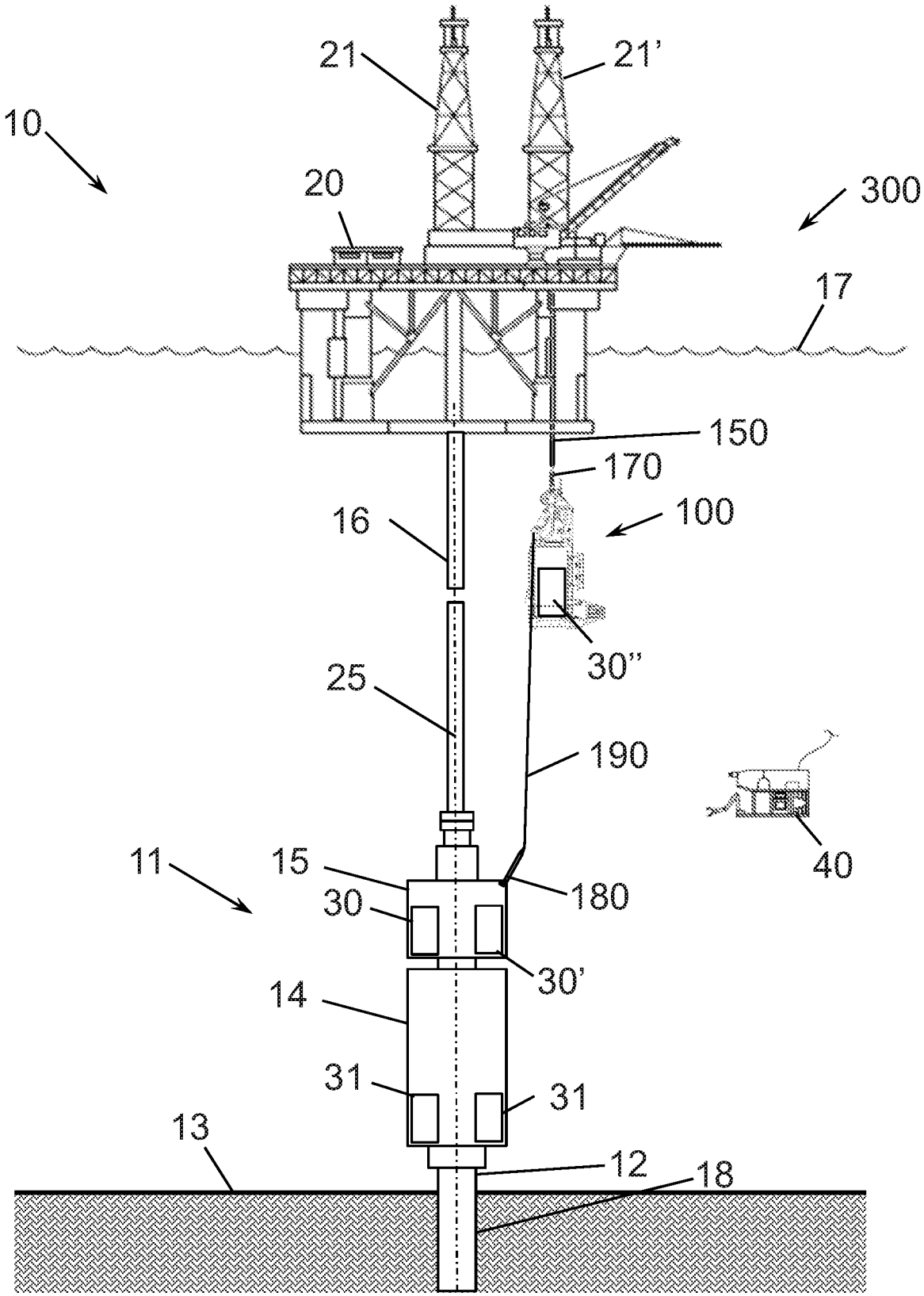

Referring now to FIG. 12C, once spears 180 are attached to BOP stack 11, derrick 21' lifts pipe string 150 to pull any slack from cables 190, resulting in tension being applied to cables 190 and pipe string 150. Next, derrick 21' applies sufficient tension to pipe string 150 to pull housing 140 and connector assembly 170 together, thereby transitioning connectors 175 from the locked position to the unlocked position. The lifting force applied to pipe string 150 is subsequently reduced with derrick 21', thereby decoupling and lowering housing 140 from connector assembly 170.

Figure 12D:
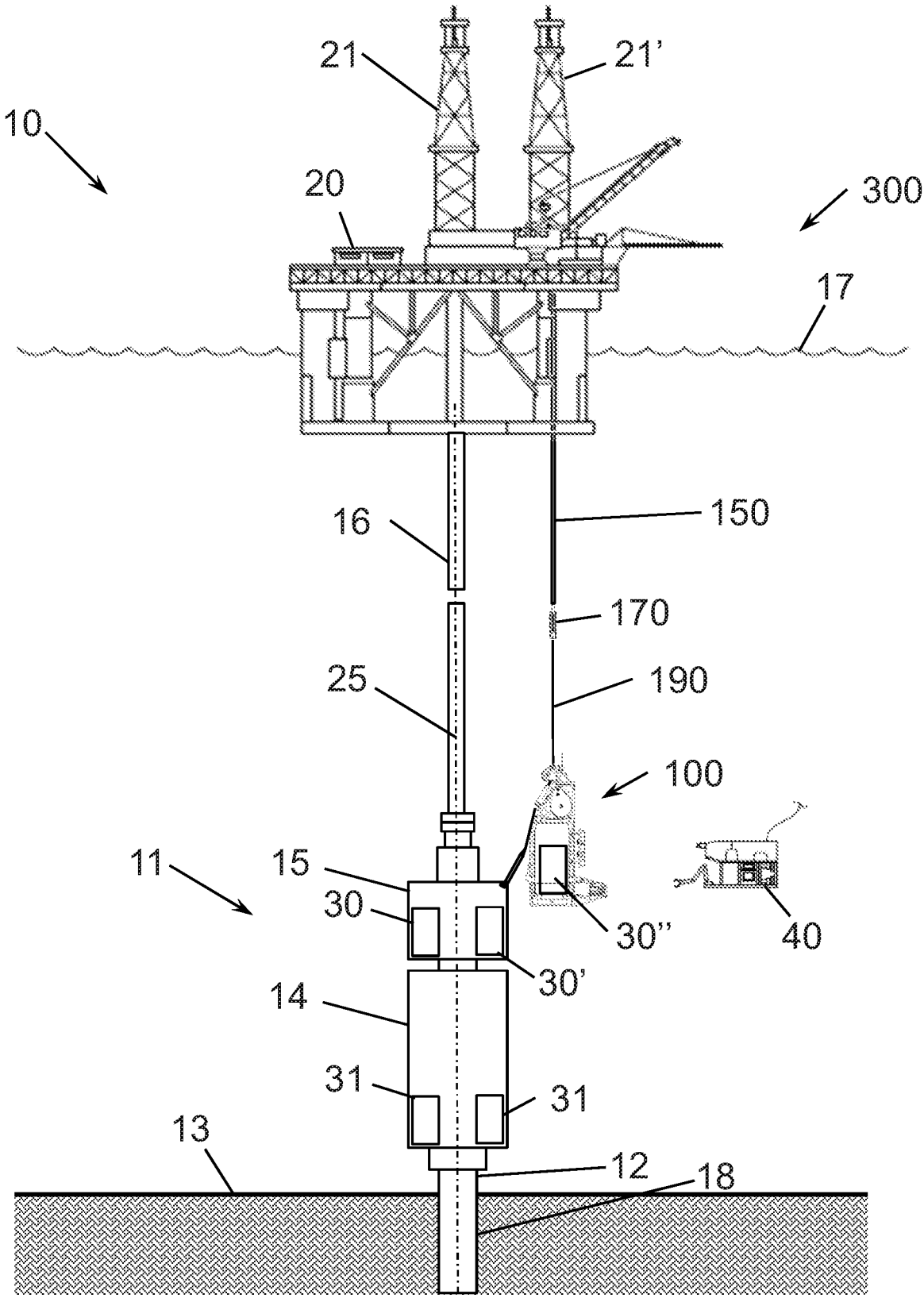
Figure 12E:
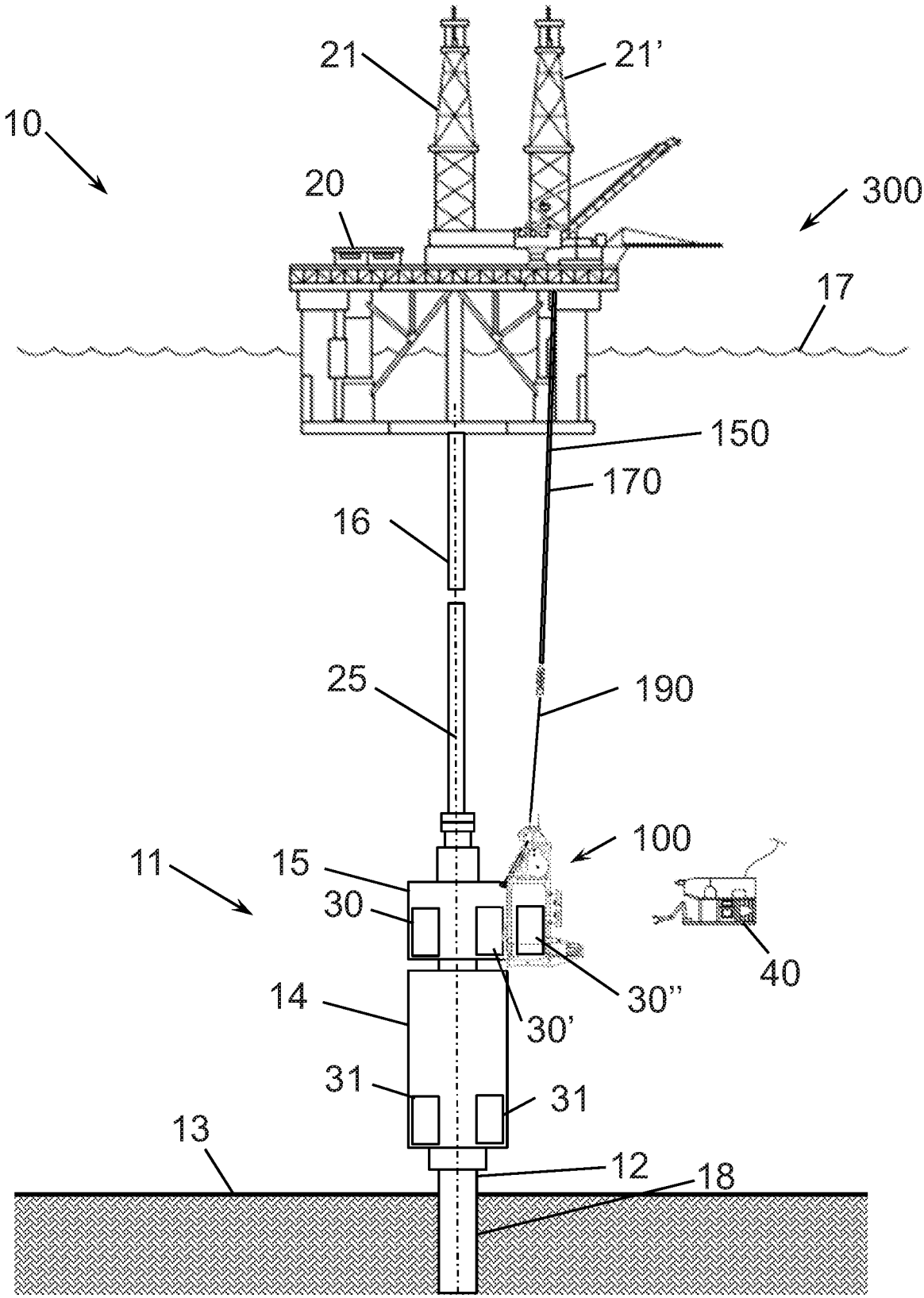

Moving now to FIGS. 12D and 12E, upon decoupling of connector assembly 170 and housing 140, housing 140 and base 110 mounted thereto are lowered with pipe string 150 from derrick 21'. It should be appreciated that connector assembly 170 is spaced from housing 140 and remains attached to pipe string 150 during this process. As pipe string 150 is lowered, cables 190 move around sheaves 173, pass through connectors 175 and the corresponding sleeves, and pass under sheaves 144 as housing 140 slides along cables 190 extending through guides 146 towards spears 180 and BOP stack 11. As housing 140 and base 110 approach BOP stack 11, spears 180 are slidingly received into guides 146, thereby aligning middle bay 117*b* in the desired positon relative to BOP stack 11 (i.e., with bay 117*b* adjacent to control pod 30').

Figure 12F:
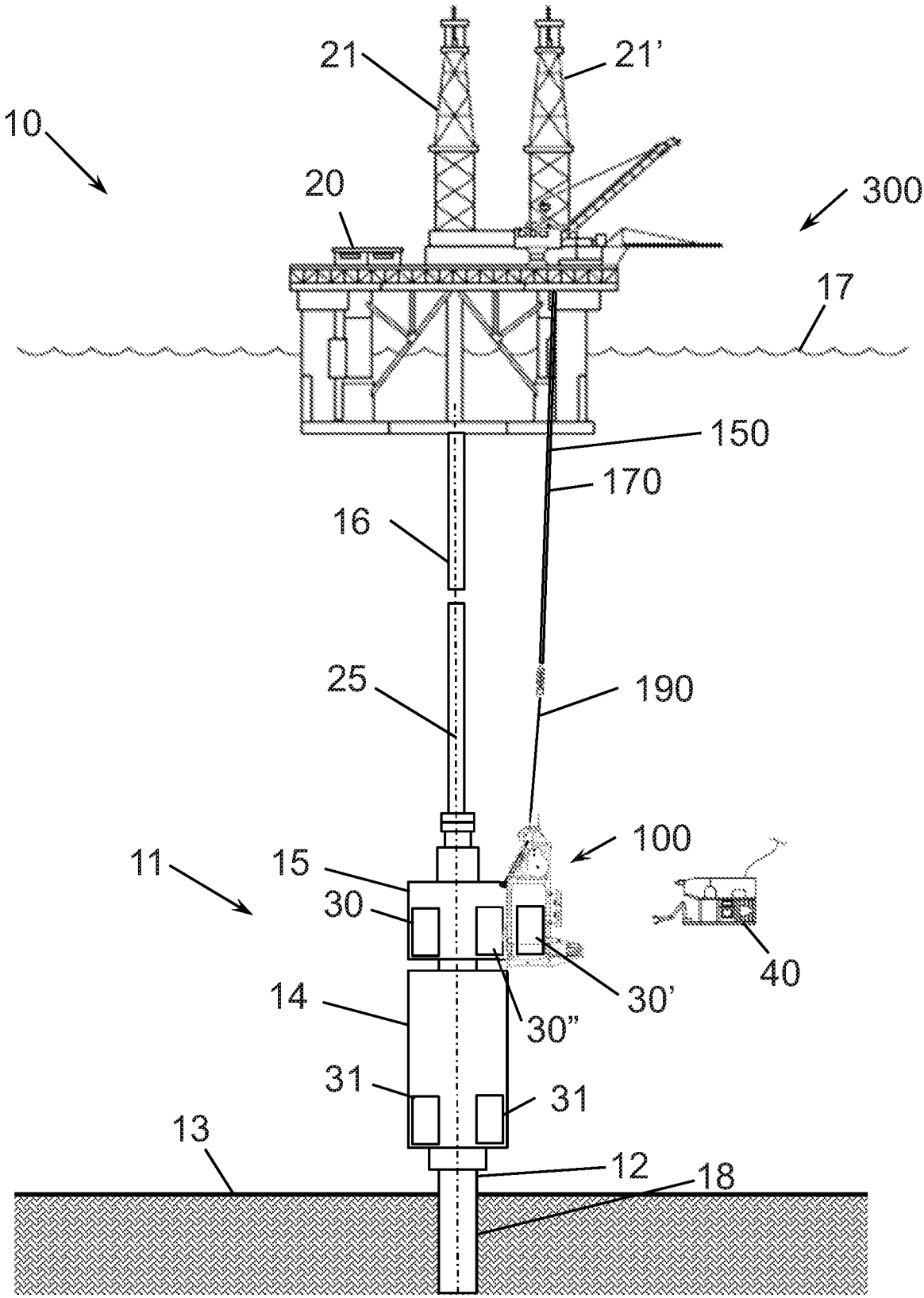

As shown in FIGS. 12E and 12F, once housing 140 is coupled to BOP stack 11 with middle bay 117*b* aligned with and adjacent the control pod 30', trolley 120 and actuation assembly 130 are used to exchange pods 30',30" (i.e., pod 30' is replaced with pod 30"). In this embodiment, pod 30' is first removed from BOP stack 11, and then, pod 30" is installed in BOP stack 11. The detailed steps for exchanging pods 30',30" after housing 140 is coupled to BOP stack 11 is as previously described and shown in FIGS. 10A-10F.

Figure 12G:
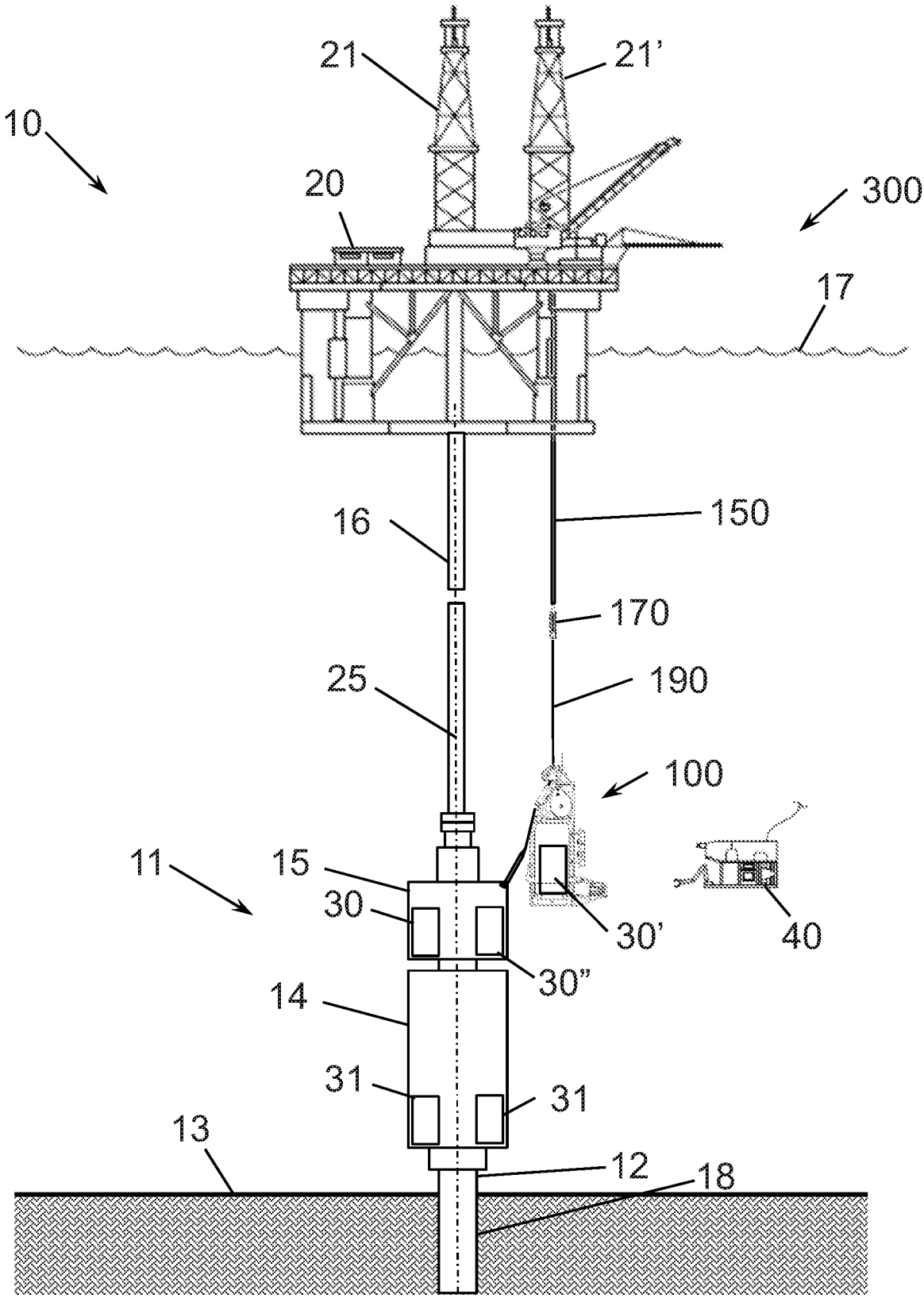
Figure 12H:
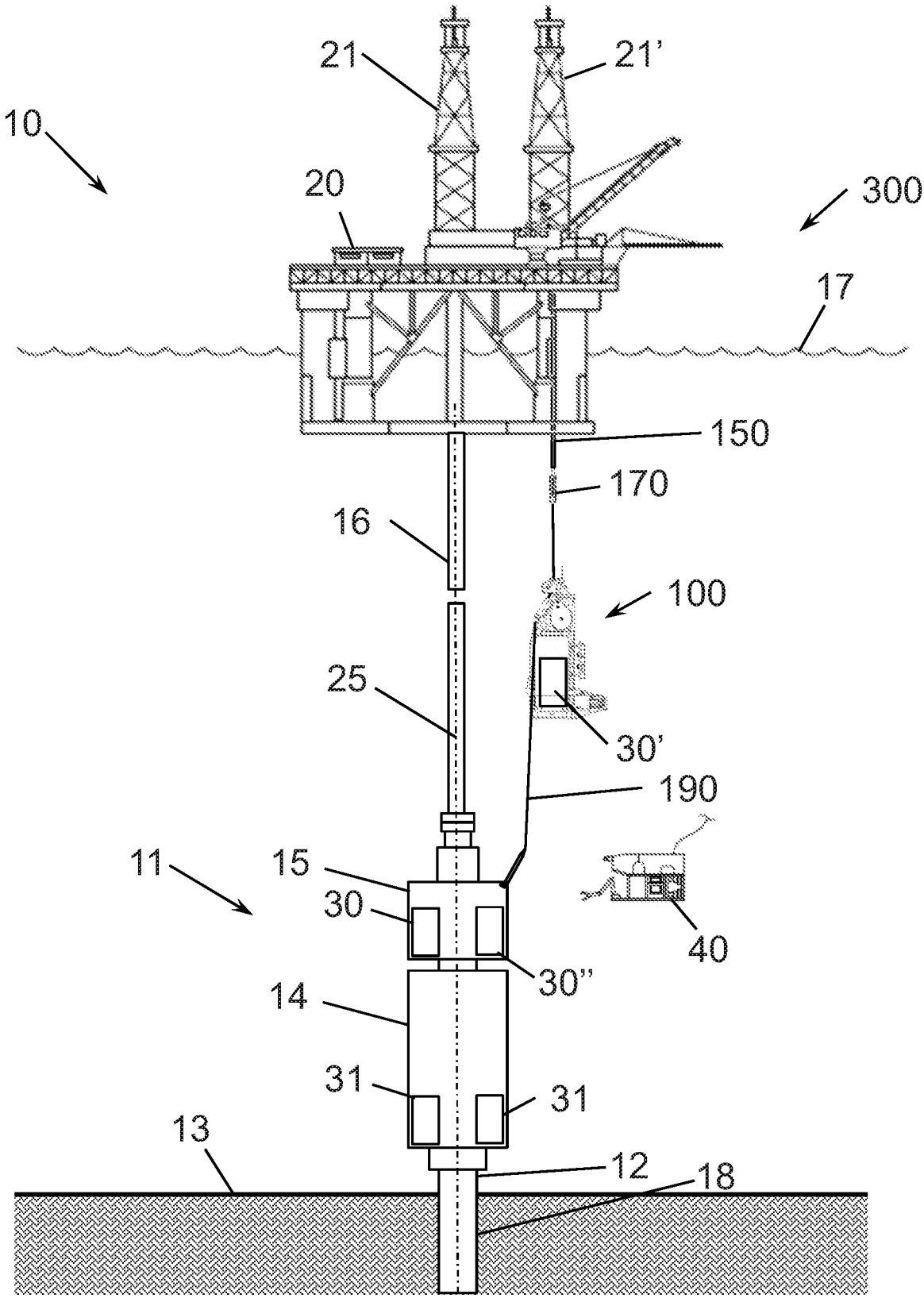

Referring now to FIGS. 12F-12H, after swapping pods 30',30", housing 140 and base 110 are lifted from BOP stack 11. In particular, derrick 21' is operated to raise pipe string 150, thereby pulling housing 140 (and base 110 attached thereto) upward toward the surface 17 and connector assembly 170. As pipe string 150 is raised, cables 190 move around sheaves 173, pass through connectors 175 and the corresponding sleeves, and pass under sheaves 144 as housing 140 slides along cables 190 as housing 140 slides along cables 190 extending through guides 146 away from spears 180 and BOP stack 11.

Figure 12I:
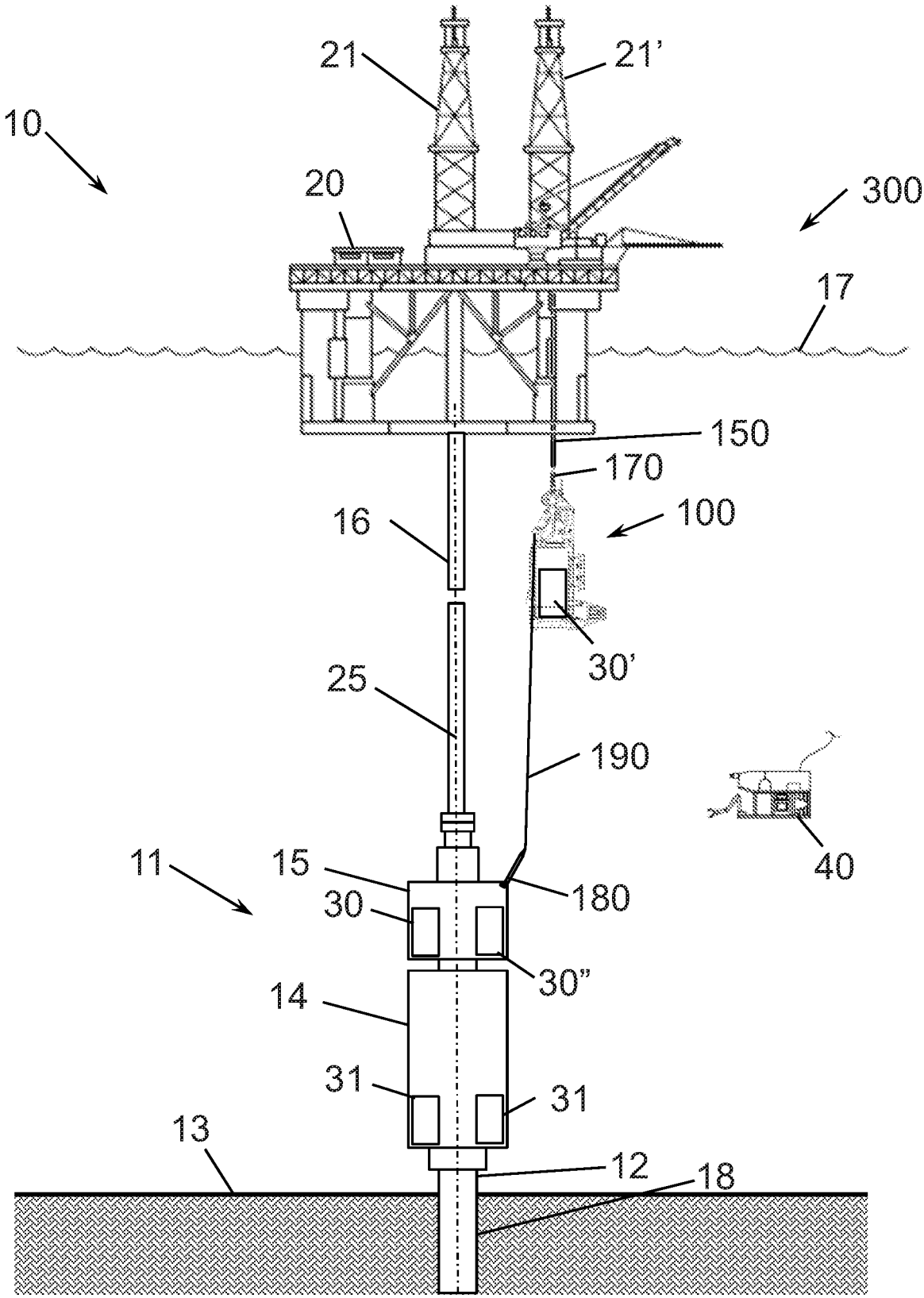

Moving now to FIG. 12I, upon arrival at connector assembly 170, stabbing members 176 on housing 140 are aligned with the mating sleeves in connector assembly 170. Derrick 21' continues to lift pipe string 150 to pull stabbing members 176 into the sleeves, and to pull housing 140 and connector assembly 170 together, thereby transitioning connectors 175 from the unlocked position to the locked position releasably coupling housing 140 and connector assembly 170 together.

Figure 12J:
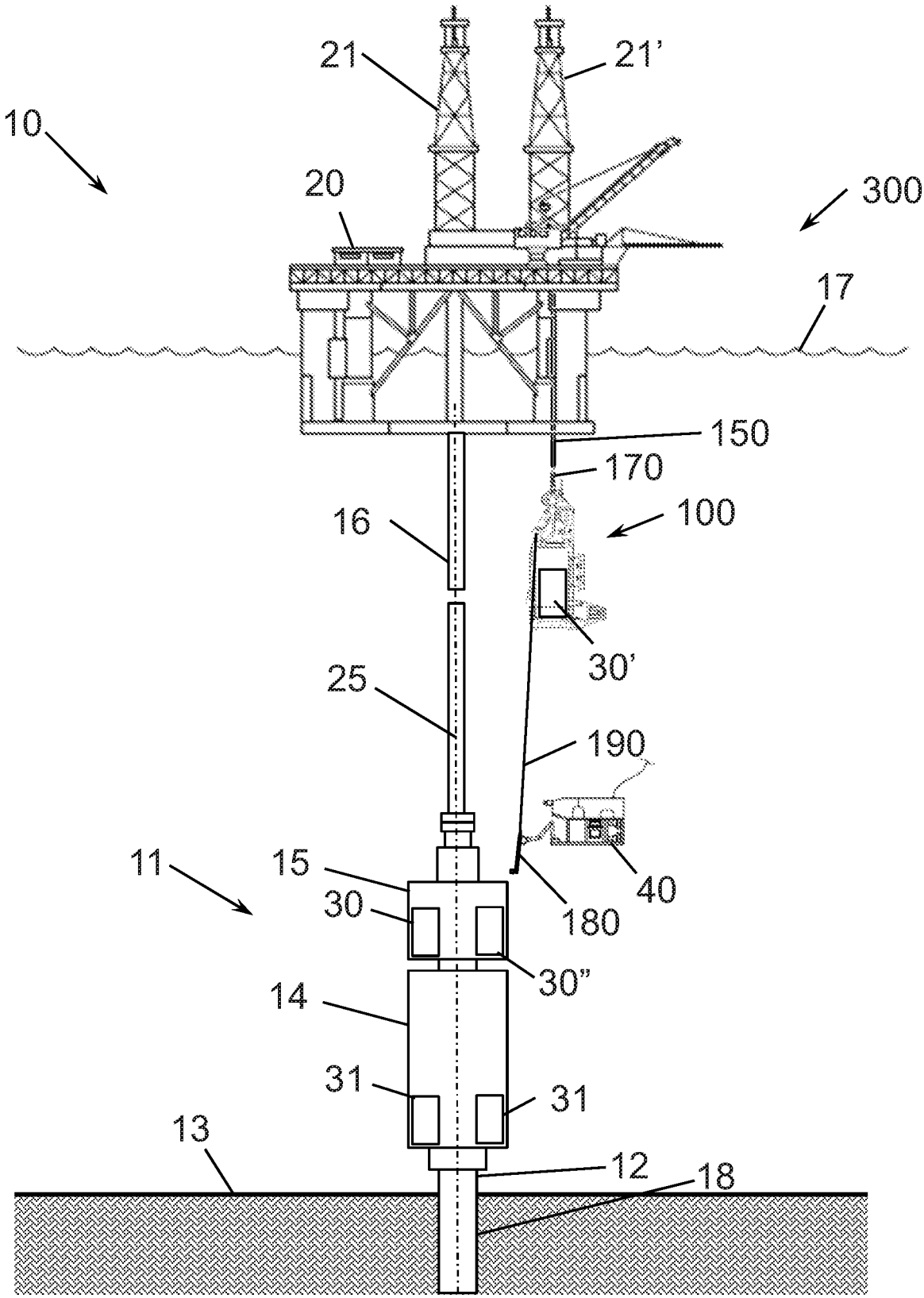
Figure 12K:
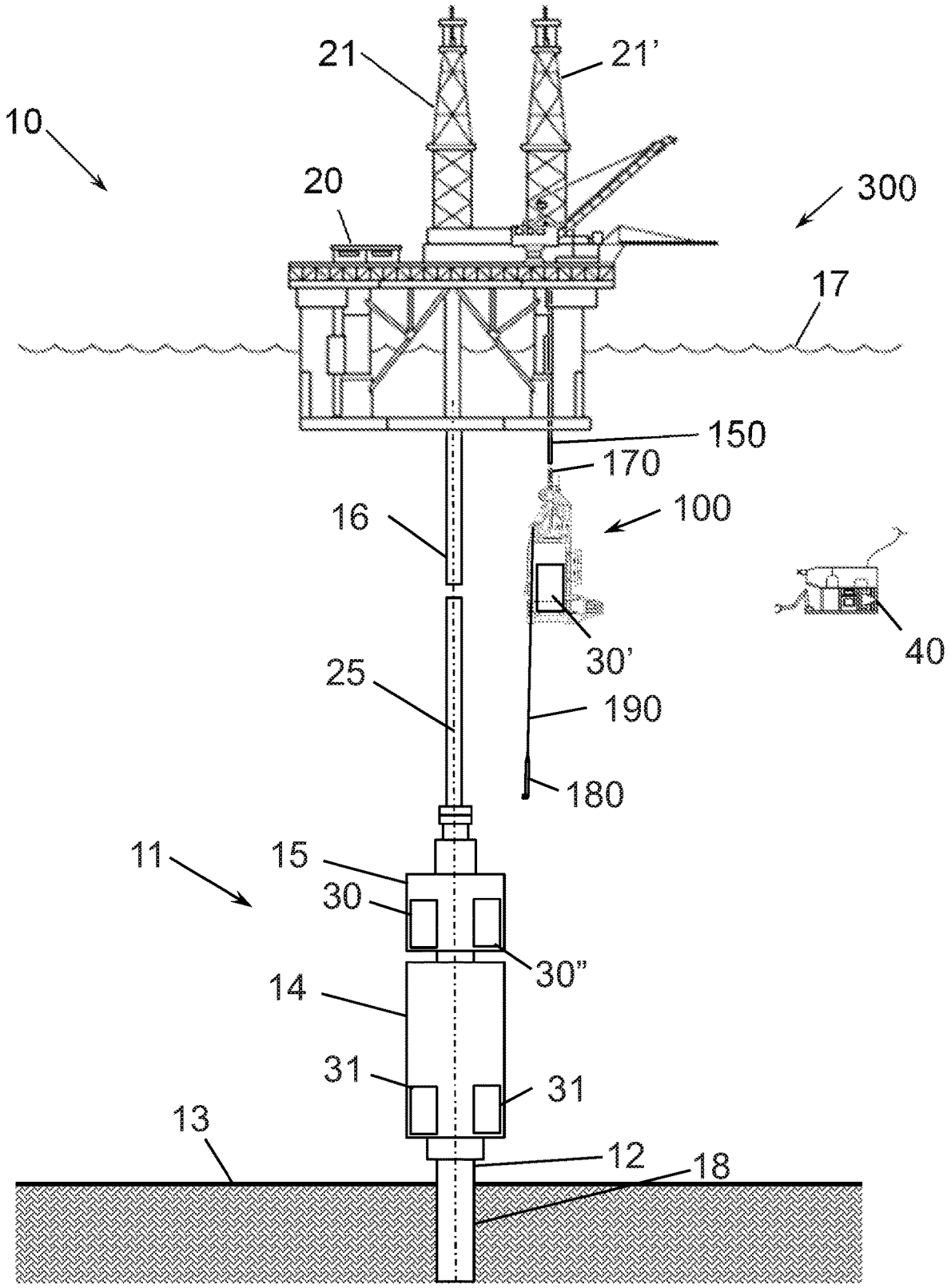

After coupling housing 140 and connector assembly 170, the weight of device 100 is supported by pipe string 150 while derrick 21' is operated to lift pipe string 150, thereby removing any tension in cables 190. Next, ROV 40 decouples spears 180 from BOP stack 11 as shown in FIG. 12J. At this point, winch 143 can be operated to pay in cables 190 and pull spears 180 upward to exchange device 100, or alternatively, cables 190 can be left hanging from exchange device 100 as derrick 21' raises exchange device 100 (carrying pod 30') to vessel 20 as shown in FIG. 12K.

In the manner described and shown in FIGS. 12A-12K, system 300 can be used to deploy control pod 30", exchange or swap control pods 30',30" at BOP stack 11, and retrieve control pod 30' to the surface 17 in a single subsea trip. During deployment of pod 30" and retrieval of pod 30', derrick 21' lowers and raises pipe string 150 to move housing 140, which carries pods 30',30", to and from BOP stack 11. Thus, in this embodiment, control over the deployment and retrieval of exchange device 100 is primarily controlled from the surface with derrick 21'. For example, winch 143 need not be operated to lower and raise exchange device 100 to and from, respectively, BOP stack 11. In addition, ROV 40 can be used to guide and/or monitor exchange device 100 (and pod 30', pod 30" disposed thereon) as it is lifted, lowered, or otherwise moved subsea. However, it should be appreciated that during deployment of pod 30", exchanging of pods 30',30" at BOP stack 11, and retrieval of pod 30', the weight of exchange device 100 (and any pod 30',30" thereon) is supported by cable 50 and/or cables 190, thereby reducing the payload lifting requirements for ROV 40.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A device for retrieving a control pod from a subsea BOP stack or deploying a control pod to a subsea BOP stack, the device comprising:

a base having a horizontally oriented longitudinal axis, a first end, and a second end axially opposite the first end, wherein the base includes a plurality of laterally adjacent bays positioned horizontally side-by-side between the first end and the second end, wherein each bay is sized to hold one control pod;

a trolley moveably is disposed within the base, wherein the trolley includes a first stall and a second stall laterally adjacent the first stall, wherein each stall is configured to hold one control pod;

a housing fixably coupled to the base;

a control pod actuation assembly coupled to the housing, wherein the control pod actuation assembly is configured to move the trolley horizontally within the base relative to the base and the housing to align each stall of the trolley with at least one bay of the base, and wherein the control pod actuation assembly includes a linear actuator configured to extend and retract through one bay of the base.

2. The device of claim 1, further comprising a connector assembly releasably coupled to the housing.

3. The device of claim 2, further comprising:

a winch rotatably coupled to the housing; and a first flexible cable and a second flexible cable;

wherein the connector assembly includes a body, a first sheave rotatably coupled to the body, and a second sheave rotatably coupled to the body;

wherein the first flexible cable extends from the winch over the first sheave of the connector assembly, and wherein the second flexible cable extends from the winch over the second sheave of the connector assembly;

wherein the winch is configured to pay in and pay out the first flexible cable and the second flexible cable.

4. The device of claim 3, further comprising:

a first tubular guide coupled to the housing and a second tubular guide coupled to the housing;

a first spear configured to be slidingly received by the first tubular guide; and a second spear configured to be slidingly received by the second tubular guide.

5. The device of claim 4, wherein the first flexible cable has a first end coupled to the winch and a second end coupled to the first spear; and wherein the second flexible cable has a first end coupled to the winch and a second end coupled to the second spear.

6. The device of claim 1, wherein the plurality of axially adjacent bays includes a first bay proximal the first end of the base, a second bay proximal the second end of the base, and a third bay axially positioned between the first bay and the second bay;

wherein the control pod actuation assembly is configured to move the trolley from a first position with the first stall aligned with the second bay and a second position with the second stall aligned with the second bay.

7. The device of claim 1, further comprising a control pod interface assembly coupled to an end of the linear actuator of the control pod actuation assembly, wherein the control pod interface assembly is configured to releasably engage a control pod.

8. A method for replacing a first control pod of a BOP stack with a second control pod, the method comprising:

(a) loading the second control pod onto a base of a control pod exchange device, wherein the control pod exchange device includes the base, a housing fixably coupled to the base, a trolley moveably disposed within the base, and a connector assembly releasably connected to the housing, wherein the base includes a first bay and a second bay laterally adjacent the first bay, wherein each bay is sized to hold the first control pod or the second control pod, wherein the trolley includes a first stall and a second stall laterally adjacent the first stall, wherein each stall is configured to hold one control pod;

(b) lowering the control pod exchange device subsea after (a) with the second control pod in the first bay of the base and the first stall of the trolley;

(c) coupling a BOP stack interface member to the BOP stack after (b), wherein a flexible cable has a first end coupled to the housing and a second end coupled to the BOP stack interface member;

(d) disconnecting the connector assembly from the housing after (c);

(e) lowering the base, the trolley, and the housing relative to the connector assembly and to the BOP stack after (d);

(f) coupling the base and the housing to the BOP stack;

(g) simultaneously transferring the first control pod from the BOP stack horizontally into the second bay of the base and the second stall of the trope with the second control pod in the first bay of the base and the first stall of the trolley after (f); and (h) moving the first control pod and the second control pod horizontally within the base with the trolley after (g).

9. The method of claim 8, wherein (b) comprises lowering the control pod exchange device subsea with a pipe string suspended from a derrick mounted to a surface vessel.

10. The method of claim 9, wherein (e) comprises lowering the pipe string with the derrick.

11. The method of claim 9, further comprising:

applying a lifting force to the pipe string and the flexible cable after (c) and before (d);

wherein (d) comprises:

(d1) increasing the lifting force applied to the pipe string with the derrick to pull the housing to the connector assembly;

(d2) decreasing the lifting force applied to the pipe string with the derrick after (d1) to lower the housing relative to the connector assembly.

12. The method of claim 8, wherein (b) comprises lowering the control pod exchange device subsea with a wire rope extending from a lifting device mounted to a surface vessel.

13. The method of claim 12, wherein (e) comprises paying out the wire rope.

14. The method of claim 13, further comprising:

applying a tension to the rope and the flexible cable with the lifting device after (c) and before (d);

wherein (d) comprises:

(d1) increasing the tension in the rope with the lifting device to pull the housing to the connector assembly;

(d2) decreasing the tension in the rope with the lifting device after (d1) to lower the housing relative to the connector assembly.

15. The method of claim 8, wherein the flexible cable extends over a sheave of the connector assembly.

16. The method of claim 8, wherein (f) comprises:

aligning the base and the housing of the control pod exchange device to a predetermined orientation relative to the BOP stack by slidingly receiving the BOP stack interface member into a tubular guide coupled to the housing.

17. The method of claim 16, further comprising:

(i) moving the first control pod from the second bay to a third bay of the base with the trolley during (h), wherein the third bay is laterally adjacent to the second bay;

(j) moving the second control pod from the first bay to the second bay with the trolley during (h);

(k) moving the second control pod from the second bay to the BOP stack after (i) and (j);

(l) raising the base and the housing to the surface after (k).

* * * * *